US009949049B2

(12) United States Patent
Roh et al.

(10) Patent No.: US 9,949,049 B2
(45) Date of Patent: Apr. 17, 2018

(54) APPARATUS AND METHOD OF DETECTING AUDIO JACK

(71) Applicant: Samsung Electronics Co., Ltd., Suwon-si (KR)

(72) Inventors: Hyungdong Roh, Yongin-si (KR); Jaekeun Lee, Suwon-si (KR)

(73) Assignee: SAMSUNG ELECTRONICS CO., LTD., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/459,022

(22) Filed: Mar. 15, 2017

(65) Prior Publication Data

US 2017/0272877 A1 Sep. 21, 2017

(30) Foreign Application Priority Data

Mar. 18, 2016 (KR) ..... 10-2016-0033008
Jan. 18, 2017 (KR) ..... 10-2017-0008685

(51) Int. Cl.
*H04R 29/00* (2006.01)

(52) U.S. Cl.
CPC ..... *H04R 29/001* (2013.01)

(58) Field of Classification Search
CPC ..... H04R 29/00; H04R 29/004; H04R 5/104; H04R 2499/11; H04R 2201/07
See application file for complete search history.

(56) References Cited

U.S. PATENT DOCUMENTS

2013/0293240 A1 11/2013 Seo et al.
2014/0038460 A1* 2/2014 Lee ..... H04R 29/004 439/620.01
2014/0055167 A1 2/2014 Oh et al.
2014/0072129 A1 3/2014 Jung
2014/0225632 A1 8/2014 Oh et al.
2015/0208154 A1 7/2015 Turner
2015/0208155 A1 7/2015 Turner
2015/0326970 A1* 11/2015 Miske ..... H04R 1/1041 381/123

FOREIGN PATENT DOCUMENTS

JP 2010-166130 7/2010
JP 2015-233217 12/2015

* cited by examiner

*Primary Examiner* — Melur Ramakrishnaiah
(74) *Attorney, Agent, or Firm* — Muir Patent Law, PLLC

(57) ABSTRACT

An audio jack detection circuit includes an impedance detecting circuit configured to generate a detection signal corresponding to an impedance between a ground pin and a ground detection pin, which are in contact with a ground terminal of an audio jack socket, and a controller configured to determine a state of the audio jack socket based on the detection signal. A detection range of the impedance detected by the impedance detector may be controlled by varying a resistance of a pull-up resistor connected to the ground detection pin.

20 Claims, 22 Drawing Sheets

APPARATUS AND METHOD OF DETECTING AUDIO JACK

CROSS-REFERENCE TO RELATED APPLICATIONS

This application claims the benefit of priority under 35 U.S.C. 119 to Korean Patent Application Nos. 10-2016-0033008, filed on Mar. 18, 2016, and 10-2017-0008685, filed on Jan. 18, 2017, in the Korean Intellectual Property Office, the disclosures of each of which are incorporated herein in their entireties by reference.

BACKGROUND

The present disclosure relates to an apparatus and method of detecting an audio jack, and more particularly, to an apparatus capable of detecting whether a foreign material other than an audio jack has flowed into an audio jack socket and a method of operating the apparatus.

Audio accessories, such as earphones, headphones, a headset, a speaker, and a microphone, may include an audio jack. The audio jack may be inserted into an electronic device including an audio jack socket and receive a signal from an audio device or transmit the audio signal to the audio device. The electronic device may detect whether the audio jack has been inserted into the audio jack socket and differently operate based on the detection result. For example, when the audio jack is not detected, the electronic device may block an audio signal transmitted through the audio jack socket, and block the supply of power to a block configured to generate the audio signal. For example, in a portable electronic device, such as a smartphone, it is possible that a foreign material other than an audio jack will flow into an audio jack socket. Thus, it may be important to precisely detect whether the audio jack has been inserted into the audio jack socket to reduce power consumption of the electronic device as well as to prevent occurrence of a malfunction in the electronic device.

SUMMARY

The present disclosure provides an apparatus and method of detecting an audio jack. Specifically, the present disclosure provides an apparatus including an audio jack detection circuit and a method of operating the apparatus.

According to an aspect of the present disclosure, there is provided an audio device including a first impedance detecting circuit having a different detection range depending on a detection mode, the first impedance detecting circuit configured to generate at least one ground detection signal corresponding to a first impedance between a ground pin and a ground detection pin, which are in contact with a ground terminal of an audio jack when the audio jack is inserted in an audio jack socket, and a controller configured to generate a control signal for setting the detection mode and generate one of first to third output signals corresponding respectively to an open state of the audio jack socket, a moisture state of the audio jack socket in which a conductive material other than the audio jack is inserted into the audio jack socket, and a state of insertion of the audio jack into the audio jack socket, based on the at least one ground detection signal.

According to another aspect of the present disclosure, there is provided an audio device including an audio jack socket including a first signal pin, a jack detection pin, a second signal pin, a ground pin, a ground detection pin, and a microphone pin, which are exposed on an inner wall of the audio jack socket, an audio jack detection circuit configured to detect a first impedance between the ground pin and the ground detection pin in each of at least two detection modes having different detection ranges, the audio jack detection circuit configured to generate an output signal indicating whether the audio jack socket is in a moisture state in which a conductive material other than the audio jack is inserted into the audio jack socket, based on the detected first impedance, and an audio signal processing module configured to initiate or interrupt communication with the audio jack socket in response to the output signal.

According to another aspect of the present disclosure, there is provided an audio device including an audio jack socket including a ground pin and a ground detection pin which are exposed on an inner wall of the audio jack socket; a first circuit having a first terminal connected to a variable voltage source configured to provide a pull-up voltage to the first terminal and a second terminal connected to the ground detection pin of the audio socket, wherein the first circuit has a first resistance in a first detection mode, and has a second resistance in a second detection mode, the second resistance being lower than the first resistance; and a second circuit configured to generate a corresponding control signal for setting the first detection mode and the second detection mode and generate one of first to third output signals corresponding respectively to a first state of the audio jack socket in which nothing is inserted into the audio jack socket, a second state of the audio jack socket in which a conductive material other than the audio jack is inserted into the audio jack socket, and a third state in which the audio jack is inserted into the audio jack socket, based on the at least one ground detection signal corresponding to an impedance between the ground pin and the ground detection pin.

According to another aspect of the present disclosure, there is provided a method of detecting an audio jack configured to be inserted into an audio jack socket of an audio device, including: generating a first control signal for setting a first detection mode; determining, during the first detection mode, whether the audio jack socket is in an open state based on a first detection signal; generating a first output signal corresponding to the open state of the audio jack socket when it is determined that the audio jack socket is in the open state; generating a second control signal for setting a second detection mode when it is determined that the audio jack socket is not in the open state; determining, during the second detection mode, whether the audio jack socket is in a moisture state in which conductive material other than the audio jack is inserted into the audio jack socket; generating a second output signal corresponding to the moisture state of the audio jack socket when it is determined that the audio jack socket is in the moisture state; and generating, during the second detection mode, a third output signal corresponding to an audio jack insertion state of the audio jack socket when it is determined that the audio jack socket is not in the moisture state.

BRIEF DESCRIPTION OF THE DRAWINGS

Embodiments of the present disclosure will be more clearly understood from the following detailed description taken in conjunction with the accompanying drawings in which.

DETAILED DESCRIPTION OF THE EMBODIMENTS

Figure 1:
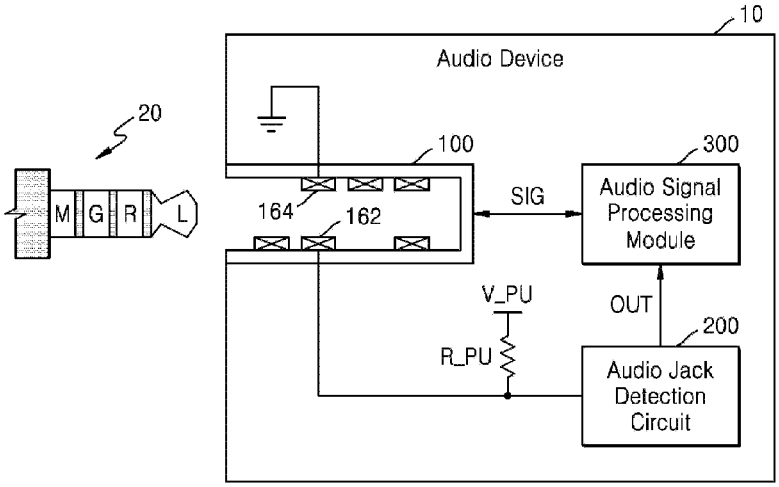
FIG. 1 is a block diagram of an audio device according to an exemplary embodiment.

The present disclosure now will be described more fully hereinafter with reference to the accompanying drawings, in which various embodiments are shown. The invention may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

Unless the context indicates otherwise, the terms first, second, third, etc., are used as labels to distinguish one element, component, region, layer or section from another element, component, region, layer or section (that may or may not be similar). Thus, a first element, component, region, layer or section discussed below in one section of the specification (or claim) may be referred to as a second element, component, region, layer or section in another section of the specification (or another claim).

Contact plugs may be, for example, conductive plugs formed of a conductive material such as a metal. The wiring patterns described above may also be formed of a conductive material, for example, a metal, and each may be formed horizontally within the die.

It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, or as "contacting" or "in contact with" another element, there are no intervening elements present. Other words used to describe the relationship between elements should be interpreted in a like fashion (e.g., "between" versus "directly between," "adjacent" versus "directly adjacent," etc.).

Terms such as "about" or "approximately" may reflect amounts, sizes, orientations, or layouts that vary only in a small relative manner, and/or in a way that does not significantly alter the operation, functionality, or structure of certain elements. For example, a range from "about 0.1 to about 1" may encompass a range such as a 0%-5% deviation around 0.1 and a 0% to 5% deviation around 1, especially if such deviation maintains the same effect as the listed range.

As is traditional in the field of the inventive concepts, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

FIG. 1 is a block diagram of an audio device 10 according to an exemplary embodiment. When an audio jack 20 of audio accessories, such as earphones, headphones, a headset, a speaker, and a microphone, is inserted in an audio jack socket 100, the audio device 10 may communicate with the audio jack socket 100 and transmit an audio signal SIG to the audio accessories or receive the audio signal SIG from the audio accessories.

Referring to FIG. 1, the audio jack 20 may include four terminals M, G, R, and L. An audio accessory including the audio jack 20 may output an electric signal, into which sound is converted, through a microphone terminal M. A ground electric potential of the audio device 10 into which the audio jack 20 is inserted may be applied to a ground terminal G. The audio jack 20 may receive an audio signal, which is provided to a right output component (e.g., a right speaker) of the audio accessory, through a right signal terminal R, and receive an audio signal, which is provided to a left output component (e.g., a left speaker) of the audio accessory, through a left signal terminal L. Thus, the audio jack 20 including the four terminals M, G, R, and L including the microphone terminal M may be referred to as a 4-pole audio jack. Unlike shown in FIG. 1, it will be understood that an audio jack 20 including three terminals G, R, and L but not the microphone terminal M may be referred to as a 3-pole audio jack. Embodiments described below may be applied not only to the 3-pole audio jack but also to a 5-pole audio jack including an additional terminal, e.g., a noise cancellation terminal. Also, the arrangement of the terminals M, G, R, and L of the audio jack 20 shown in FIG. 1 is only an example, and it will be understood that the terminals M, G, R, and L may be arranged differently than shown in FIG. 1.

Referring to FIG. 1, the audio device 10 may include the audio jack socket 100, an audio jack detection circuit 200, and an audio signal processing module 300 (e.g., an audio signal processing circuit). The audio device 10 may be embodied by, but is not limited to, a personal computer (PC), a tablet PC, a mobile phone, a smartphone, an e-reader, a personal digital assistant (PDA), an enterprise digital assistant (EDA), a digital still camera, a digital video camera, a portable multimedia player (PMP), a personal navigation device or portable navigation device (PND), and/or a handheld game console.

Referring to FIG. 1, the audio signal processing module 300 may process audio data, generate an audio signal SIG, and transmit the audio signal SIG to the audio jack 20 of the audio accessory (e.g., earphones, headphones, a headset, and a speaker), which is inserted in the audio jack socket 100 of the audio device 10 and outputs sound). Also, the audio signal processing module 300 may receive an audio signal SIG from the audio jack 20 of the audio accessory (e.g., a microphone), which is inserted in the audio jack socket 100 and converts sound into an electric signal, processes the received audio signal, and generates audio data. For example, the audio data may be digital data, which may be stored in a computer-readable storage device or data compressed by a codec. The audio data may be, but is not limited to, files having extensions, such as wma, mp3, mpga, rbs, mpeg3, way, ra, rm, ram, m4a, m4b, mp4, m4r, mp4a, flac, aac, au, mp2, aif, aiff, aifc, amr, awb, ogg, oga, .voc, wv, asf, mpc, ac3, mod, s3m, xm, it, 669, amf, ams, dbm, dmf, dsm, far, mdl, med, mtm, okt, ptm, stm, ult, umx, mt2, psm, spx, 3gp, 3gpp, 3ga, 3g2, ape, shn, vqf, tta, qcp, qcelp, dts, caf, gsm, mus, w64, act, opus, alaw, oma, adx, and so on.

Referring to FIG. 1, the audio jack detection circuit 200 may be connected to the audio jack socket 100 and generate an output signal OUT and provide the output signal OUT to the audio signal processing module 300. The output signal OUT generated by the audio jack detection circuit 200 may indicate whether the audio jack 20 has been inserted in the audio jack socket 100. The audio signal processing module 300 may control communication with the audio jack socket 100 in response to the received output signal OUT. For example, when the output signal OUT indicates a state of insertion of the audio jack 20 into the audio jack socket 100, the audio signal processing module 300 may transmit an audio signal SIG to the audio jack socket 100 or receive the audio signal SIG from the audio jack socket 100. In another case, when the output signal OUT indicates a state (e.g., an open state or a state of the inflow of a foreign material) in which the audio jack 20 is not inserted into the audio jack socket 100, the audio signal processing module 300 may block the transmission of an audio signal SIG to the audio jack socket 100, cut connection with a line through which an audio signal SIG is transmitted, or block the supply of power to a circuit configured to generate or process the audio signal SIG.

According to an exemplary embodiment, the audio jack detection circuit 200 may detect an impedance between a ground pin 164 and a ground detection pin 162 (i.e., a node having a ground electric potential), which are in contact with the ground terminal G of the audio jack 20 when the audio jack 20 is inserted in the audio jack socket 100, from among a plurality of pins of the audio jack socket 100, and determine whether the audio jack 20 has been inserted into the audio jack socket 100 based on the detected impedance. Thus, using the ground detection pin 162 instead of another pin (e.g., a jack detection pin 122 shown in FIGS. 2A to 2C) of the audio jack socket 100 may be advantageous for detecting whether the audio jack 20 has been inserted into the audio jack socket 100. For example, even with a variation in electric signal applied to one of both the ground detection pin 162 and the ground pin 164 to detect an impedance between the ground detection pin 162 and the ground pin 164, noise that may occur at audio accessories including the audio jack 20 may be removed. Thus, a range of the impedance between the ground detection pin 162 and the ground pin 164, which may be detected by the audio jack detection circuit 200, may be extended. Therefore, it may be possible to precisely determine whether the audio jack 20 has been inserted into the audio jack socket 100 or a foreign material has flowed into the audio jack socket 100.

According to an exemplary embodiment, the audio jack detection circuit 200 may vary a resistance of a pull-up resistor connected to the ground detection pin 162 and control a detection range of an impedance. Referring to FIG. 1, a pull-up resistor R_PU may be located between the ground detection pin 162 and the pull-up voltage V_PU, and the audio jack detection circuit 200 may detect an impedance between the ground detection pin 162 and the ground pin 164 based on a voltage of the ground detection pin 162. To determine whether the audio jack 20 has been inserted in the audio jack socket 100, the resistance of the pull-up resistor R_PU may be, for example, about 1 MΩ to about 10 MΩ. As described below with reference to FIGS. 2A to 2C, the ground terminal G of the audio jack 20 may nearly short-circuit both the ground detection pin 162 and the ground pin 164, while a foreign material (e.g., water or other conductive material other than the audio jack 20 that is able to conduct a flow of current between the ground detection pin 162 and the ground pin 164) may have a resistance of about 20 kΩ to about 300 kΩ. To precisely determine whether the audio jack 20 has been inserted in the audio jack socket 100 and whether the foreign material has flowed into the audio jack socket 100, a detection range of the impedance between the ground detection pin 162 and the ground pin 164 may be controlled by varying the resistance of the pull-up resistor R_PU connected to the ground detection pin 162. Although the pull-up resistor R_PU is illustrated outside the audio jack detection circuit 200 in FIG. 1 for brevity, the pull-up resistor R_PU may be included in the audio jack detection circuit 200 as described below.

Figure 2A:
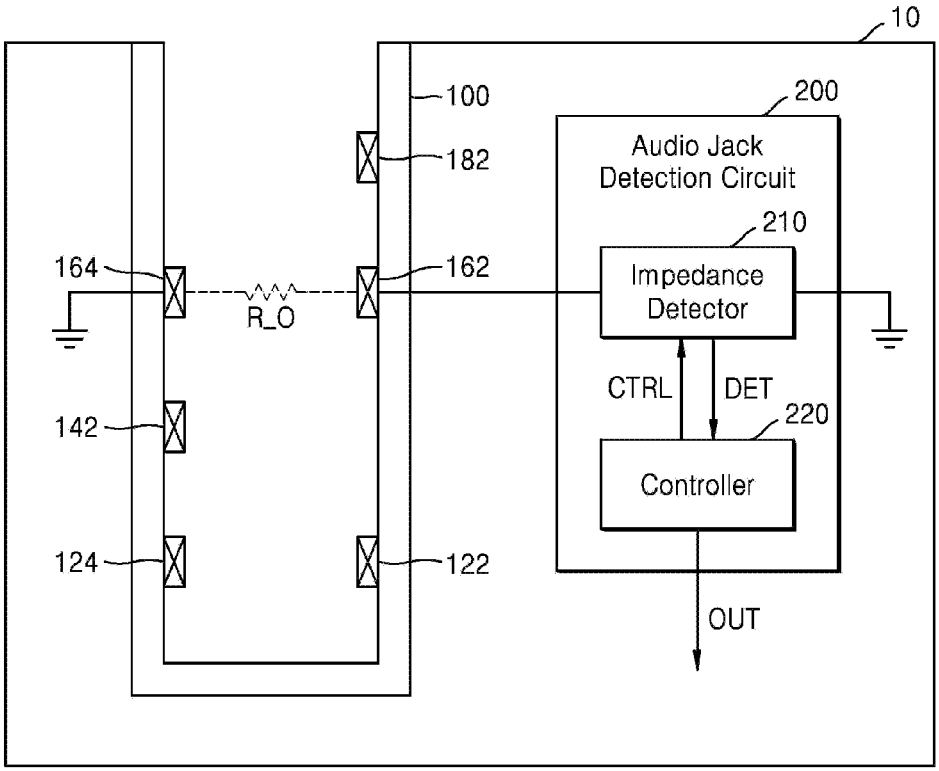
FIGS. 2A to 2C illustrate possible states of the audio jack socket of FIG. 1, according to exemplary embodiments.
Figure 2B:
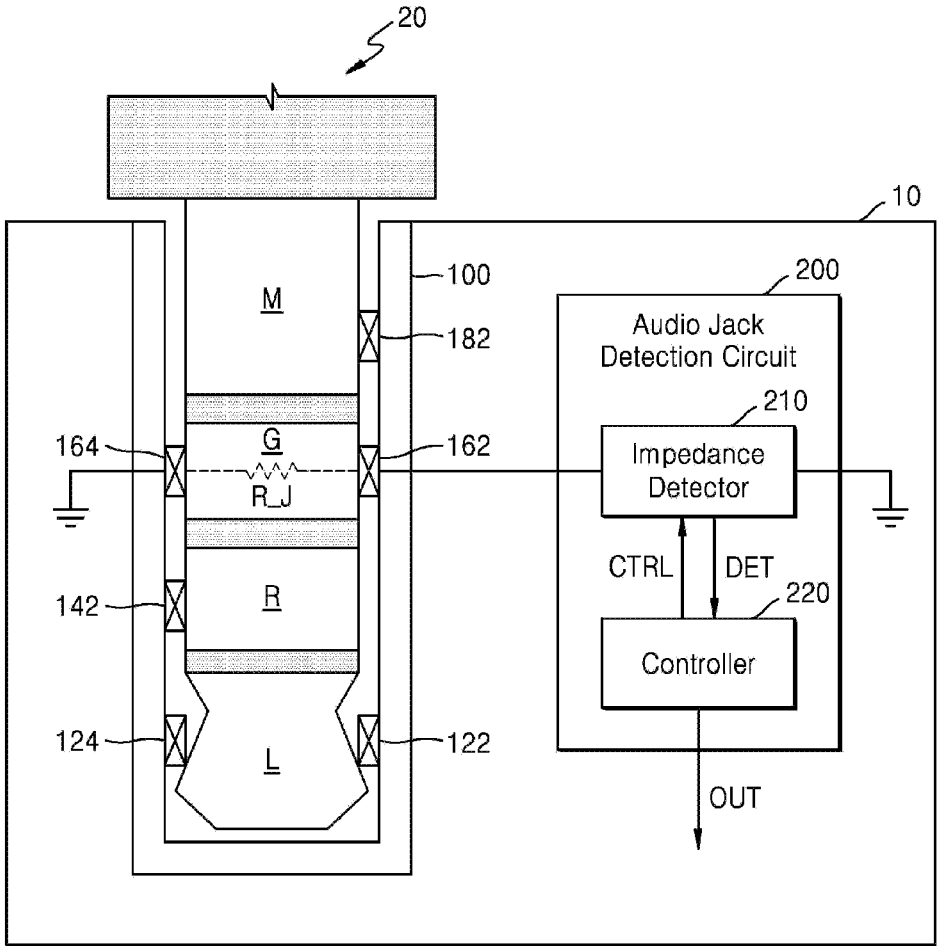
Figure 2C:
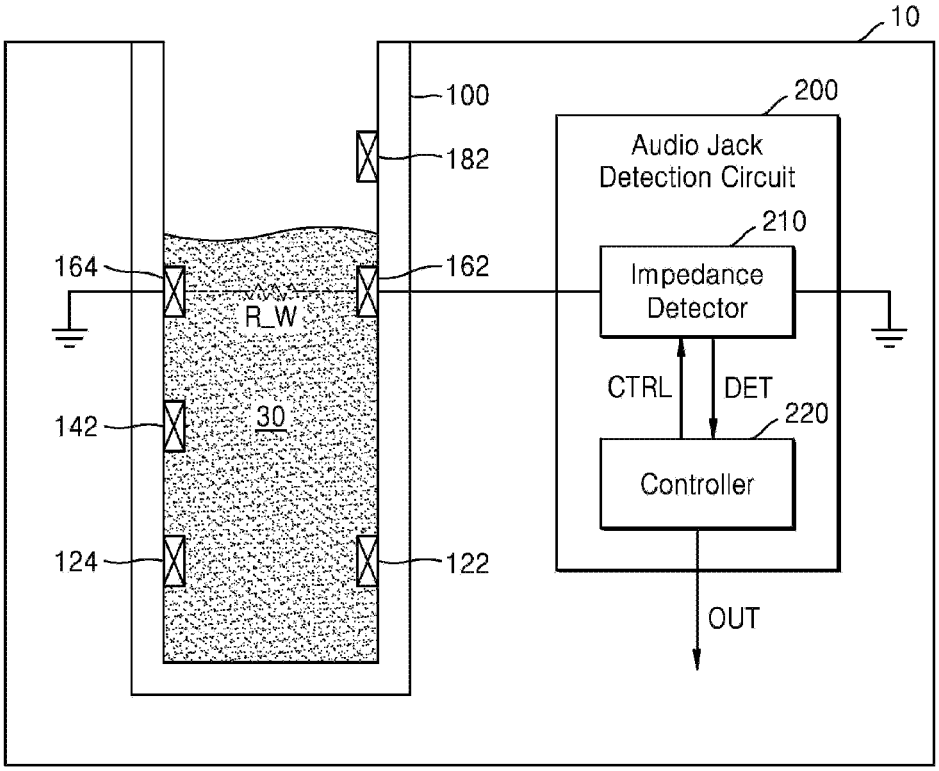

FIGS. 2A to 2C illustrate possible states of the audio jack socket 100 of FIG. 1, according to exemplary embodiments. Specifically, FIG. 2A illustrates a state (i.e., an open state) in which nothing is inserted into the audio jack socket 100, FIG. 2B illustrates a state in which the audio jack 20 is inserted in the audio jack socket 100, and FIG. 2C illustrates a state in which a foreign material 30 has flowed into the audio jack socket 100. As described above with reference to FIG. 1, the audio jack detection circuit 200 of the audio device 10 according to the present embodiment may detect an impedance between the ground detection pin 162 and the ground pin 164 of the audio jack socket 100 and determine if the audio jack 20 has been inserted in the audio jack socket 100.

Referring to FIGS. 1 and 2A to 2C, the audio jack socket 100 may include a left signal pin 124, a jack detection pin 122, a right signal pin 142, a ground detection pin 162, a ground pin 164, and a microphone pin 182. When the audio jack 20 is inserted in the audio jack socket 100, the left signal pin 124 and the jack detection pin 122 may be in contact with the left signal terminal L of the audio jack 20, the right signal pin 142 may be in contact with the right signal terminal R of the audio jack 20, the ground detection pin 162 and the ground pin 164 may be in contact with the ground terminal G of the audio jack 20, and the microphone pin 182 may be in contact with the microphone terminal M of the audio jack 20. As shown in FIGS. 2A to 2C, the jack detection pin 122, the left signal pin 124, the right signal pin 142, the ground detection pin 162, the ground pin 164, and the microphone pin 182 of the audio jack socket 100 may be exposed on an inner wall of the audio jack socket 100 and include a conductive material, such as a metal.

Referring to FIGS. 2A to 2C, the audio jack detection circuit 200 may include an impedance detector 210 (e.g., an impedance detecting circuit) and a controller 220 (e.g., a controlling circuit). The impedance detector 210 may be connected to the ground detection pin 162 of the audio jack socket 100 and provide a detection signal DET to the controller 220 and receive a control signal CTRL from the controller 220. The impedance detector 210 may have a different detection range in response to the control signal CTRL. The impedance detector 210 may detect an impedance between the ground detection pin 162 and the ground pin 164 (i.e., a node having a ground electric potential) of the audio jack socket 162 based on the detection range, and generate a detection signal DET corresponding to the detected impedance.

The controller 220 may generate a control signal CTRL for setting a detection range of the impedance detector 210, determine a state of the audio jack 20 based on the detection signal DET, and generate an output signal OUT corresponding to the determined state. For example, the controller 220 may generate a control signal CTRL based on the detection signal DET generated in a first detection range and change the detection range of the impedance detector 210 into a second detection range. Also, the controller 220 may generate an output signal OUT corresponding to a state of the audio jack socket 100 (e.g., one of an open state, an insertion state, and a moisture state of the audio jack 20) based on the detection signals DET generated by the impedance detector 210 in each of the first and second detection ranges. For example, the controller 220 may be a processor configured to execute a plurality of commands or an exclusive-use logic block, such as an application specific integrated circuit (ASIC). As described above with reference to FIG. 1, the audio signal processing module 300 of FIG. 1 may receive an output signal OUT generated by the controller 220 of the audio jack detection circuit 200, and control communication with the audio jack socket 100 based on the output signal OUT. The impedance detector 210 and the controller 220 will be described in detail later with reference to FIG. 3.

Referring to FIG. 2A, when nothing is inserted into the audio jack socket 100 (i.e., when the audio jack socket 100 is in an open state), since a conductive path is not formed between the ground detection pin 162 and the ground pin 164, a resistance R_O between the ground detection pin 162 and the ground pin 164 may be infinite. Referring to FIG. 2B, when the audio jack 20 is inserted in the audio jack socket 100, the ground detection pin 162 and the ground pin 164 may be connected in common to the ground terminal G of the audio jack 20 so that a resistance R_J between the ground detection pin 162 and the ground pin 164 may be substantially zero (0). Referring to FIG. 2C, when a foreign material 30 has flowed into the audio jack socket 100, a resistance R_W between the ground detection pin 162 and the ground pin 164 may differ according to properties of the foreign material 30. For instance, when the foreign material 30 is distilled water, the resistance R_W may be about 300 kΩ. When the foreign material 30 is tap water containing impurities, the resistance R_W may be about 150 kΩ to about 160 kΩ. When the foreign material 30 is sugared water, such as a beverage, the resistance R_W may be about 20 kΩ. Herein, a state in which the foreign material 30 has flowed into the audio jack socket 100 as shown in FIG. 2C may be referred to as a moisture state.

Thus, an impedance between the ground detection pin 162 and the ground pin 164 of the audio jack socket 100 may have various values according to a state of the audio jack socket 100. The values of the impedance may be distributed in a wide range. For example, a difference between the resistance R_O of FIG. 2A and the resistance R_W of FIG. 2C may be relatively large, while a difference between the resistance R_J of FIG. 2B and the resistance R_W of FIG. 2C may be relatively small. Thus, the controller 220 may set a detection range of the impedance detector 210 for determining an insertion state of the audio jack 20 of FIG. 2B to be different from a detection range of the impedance detector 210 for determining an insertion state of the foreign material 30 of FIG. 2C, in response to a control signal CTRL. As described below, according to an exemplary embodiment, a detection range of the impedance detector 210 may be changed by varying a resistance of a pull-up resistor connected to the ground detection pin 162. In the following drawings, pins 122, 124, 142, 162, 164, and 182 included in the audio jack socket 100 are illustrated instead of the audio jack socket 100 for brevity.

Figure 3:
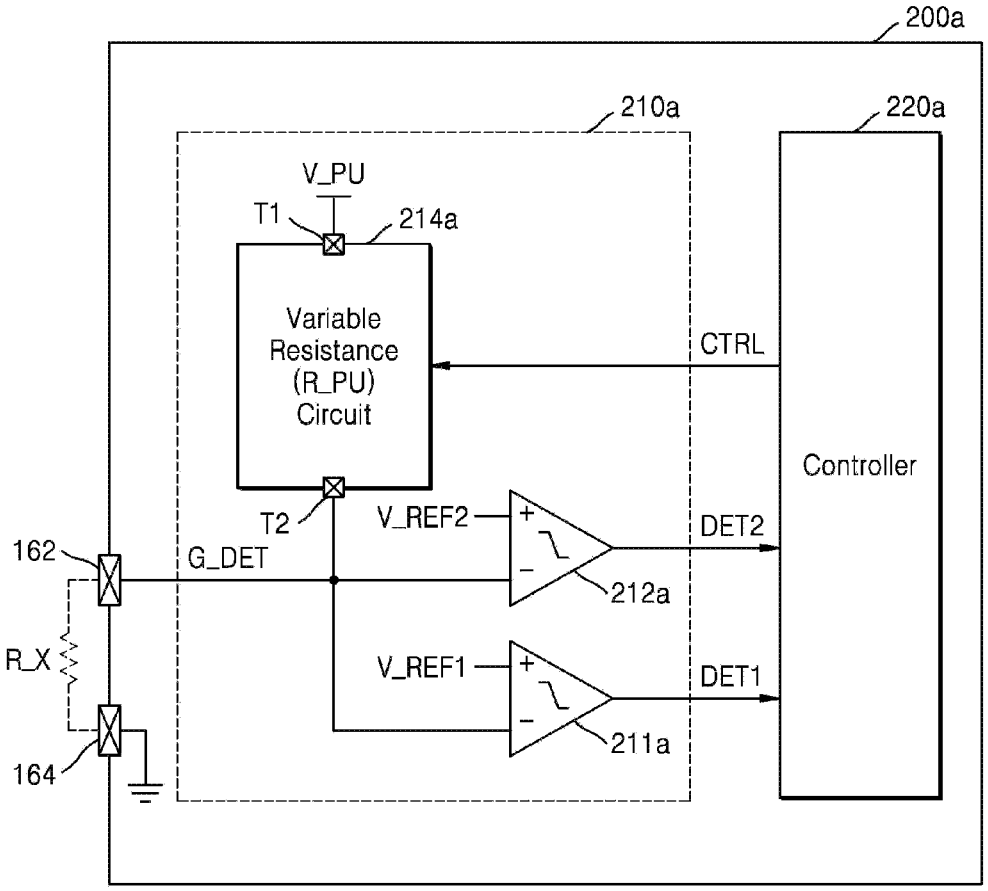
FIG. 3 is a block diagram of an audio jack detection circuit according to an exemplary embodiment.

FIG. 3 is a block diagram of an audio jack detection circuit **200*a* according to an exemplary embodiment. As described above with reference to FIGS. 2A to 2C, the audio jack detection circuit 200*a* may include an impedance detector 210*a* and a controller 220*a*. The impedance detector 210*a* may receive a control signal CTRL from the controller 220*a*, generate detection signals DET1 and DET2, and provide the detection signals DET1 and DET2 to the controller 220*a*. Also, the impedance detector 210*a* may be connected to a ground detection pin 162 and detect an impedance (e.g., a resistance R_X) between the ground detection pin 162 and the ground pin 164. As described above with reference to FIGS. 2A to 2C, the resistance R_X may vary according to a state of the audio jack socket 100. As shown in FIG. 3, the impedance detector 210*a* may include a first comparator 211*a*, a second comparator 212*a*, and a variable resistance circuit 214*a***.

Referring to FIG. 3, the variable resistance circuit **214*a* may have a first terminal T1 to which a pull-up voltage V_PU is applied and a second terminal T2 connected to the ground detection pin 162. The variable resistance circuit 214*a* may have a variable resistance R_PU between the first and second terminals T1 and T2 in response to the control signal CTRL. As described above with reference to FIGS. 2A to 2C, the control signal CTRL may set a detection range of the impedance detector 210*a*. That is, the detection range of the impedance detector 210*a* may be set due to a resistance R_PU between the first and second terminals T1** and T2 of the variable resistance circuit 214*a*, which is set based on the control signal CTRL.

Referring to FIG. 3, the first comparator 211*a* may compare a voltage G_DET of the ground detection pin 162 with a first reference voltage V_REF1. For example, the first comparator 211*a* may generate a first detection signal DET1 that is activated when the voltage G_DET of the ground detection pin 162 is lower than the first reference voltage V_REF1. In the example shown in FIG. 3, the first detection signal DET1 may be an active low signal, which has a low level during an activated period. Similarly, the second comparator 212*a* may compare a voltage G_DET of the ground detection pin 162 with a second reference voltage V_REF2. For example, the second comparator 212*a* may generate a second detection signal DET2 that is activated when the voltage G_DET of the ground detection pin 162 is lower than a second reference voltage V_REF2. In the example shown in FIG. 3, the second detection signal DET2 may be an active low signal having a low level during an activated period.

In an embodiment, the second comparator 212*a* may be used to detect a lower resistance R_X (e.g., a resistance R_W due to the foreign material 30 of FIG. 2C) than the first comparator 211*a*. That is, the second reference voltage V_REF2 may be lower than the first reference voltage V_REF1. The resistance R_PU of the variable resistance circuit 214*a* may be relatively low while the second comparator 212*a* is comparing the voltage G_DET of the ground detection pin 162 with the second reference voltage V_REF2. By varying the resistance R_PU of the variable resistance circuit 214*a* from a high value to a low value, even if the resistance R_X between the ground detection pin 162 and the ground pin 164 is relatively low (e.g., even if the foreign material 30 of FIG. 2C flows into the audio jack socket 100), the impedance detector 210 may detect the resistance R_X precisely and easily.

As shown in FIG. 3, varying a resistance of a pull-up resistor may be advantageous for detecting the resistance R_X in a wide range. For example, to change a detection range of the impedance, when a current source is connected to the ground detection pin 162 and a magnitude of current generated by the current source is changed, the voltage G_DET of the ground detection pin 162 may be about several tens mV due to a limitation in the magnitude of the current generated by the current source used to detect the audio jack 20. As a result, a comparator having high performance may be required. However, as shown in FIG. 3, when the resistance of the pull-up resistor varies, even if the resistance R_X is relatively low, the voltage G_DET of the ground detection pin 162 may rise sufficiently to be detected. As a result, a low-cost comparator may be adopted.

Figure 4:
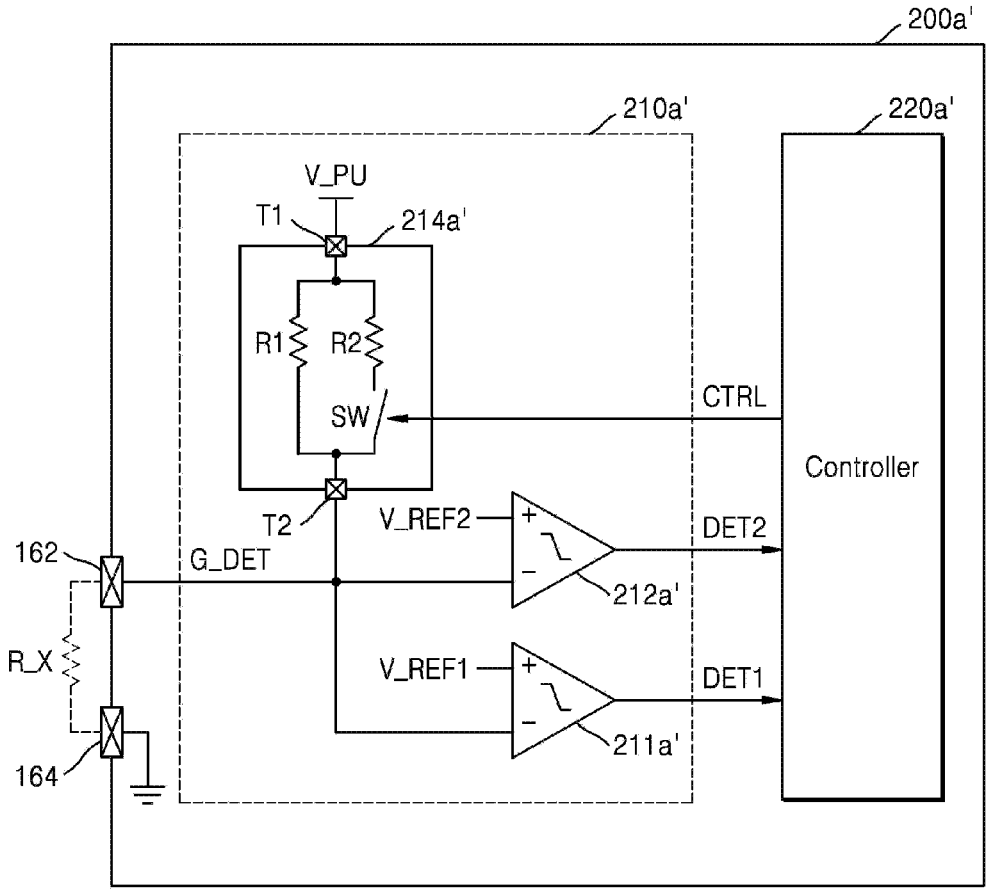
FIG. 4 is a block diagram of an audio jack detection circuit according to an exemplary embodiment.
Figure 5:
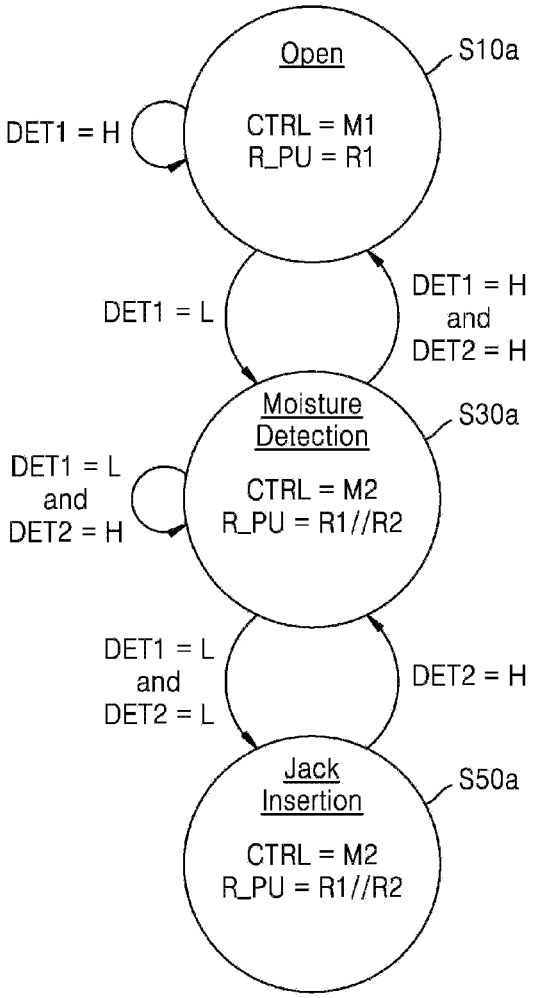
FIG. 5 is a state machine diagram corresponding to an operation of a controller of FIG. 4.

FIG. 4 is a block diagram of an audio jack detection circuit 200*a*' according to an embodiment, and FIG. 5 is a state machine diagram corresponding to an operation of a controller 220*a*' of FIG. 4. As shown in FIG. 4, an impedance detector 210*a*' of an audio jack detection circuit 200*a*' may include a first comparator 211*a*', a second comparator 212*a*', and a variable resistance circuit 214*a'*.

In an exemplary embodiment, the controller 220*a*' may set a detection mode of the impedance detector 210*a*' in response to a control signal CTRL, and determine a state of an audio jack socket 100 based on detection signals DET1 and DET2. For example, the impedance detector 210*a*' may set to one of two detection modes (i.e., first and second detection modes), each of which provides a different detection range according to the control signal CTRL, and a resistance R_PU of the variable resistance circuit 214*a*' may vary depending on a detection mode. Referring to FIG. 4, the variable resistance circuit 214*a*' may include two resistors having different resistances R1 and R2, respectively, and include a switch SW that is controlled in response to a control signal CTRL. The switch SW may be turned on in response to a control signal CTRL for setting the first detection mode, and be turned off in response to a control signal CTRL for setting the second detection mode. Thus, the resistance R_PU of the variable resistance circuit 214*a*' may be R1 in the first detection mode, and be R1//R2 (i.e., R1·R2/(R1+R2)) in the second detection mode. In an exemplary embodiment, R1 may be about 1 MΩ, R2 may be about 50 kΩ, and a pull-up voltage V_PU may be about 1.8 V. When R2 is relatively very small compared to than R1, the resistance R_PU of the variable resistance circuit 214*a*' may be approximately R2 in the second detection mode.

Referring to FIG. 5, in an open state S10*a* of the audio jack socket 100, the impedance detector 210*a*' may be set to the first detection mode by the controller 220*a*' (CTRL=M1), so that the resistance R_PU of the variable resistance circuit 214*a*' may be R1. If the first detection signal DET1 is deactivated (i.e., when the audio jack socket 100 stays in the open state), the controller 220*a*' may stay in the open state S10*a*. If the first detection signal DET1 is activated (i.e., if the audio jack 20 has been inserted in the audio jack socket 100 or if a foreign material 30 has flowed into the audio jack socket 100), the controller 220*a*' may make the transition to a moisture detection state S30*a*.

In the moisture detection state S30*a*, the impedance detector 210*a*' may be set to the second detection mode by the controller 220*a*' (CTRL=M2), so that the resistance R_PU of the variable resistance circuit 214*a*' may be reduced to R1//R2. If the first detection signal DET1 is activated and the second detection signal DET2 is deactivated (i.e., if the foreign material 30 has flowed into the audio jack socket 100 and remains in the audio jack socket 100), the controller 220*a*' may stay in the moisture detection state S30*a*. If both the first and second detection signals DET1 and DET2 are deactivated (i.e., if the audio jack socket 100 is dried or the audio jack 20 is separated from the audio jack socket 100), the controller 220*a*' may make the transition to the open state S10*a*. Otherwise, if both the first and second detection signals DET1 and DET2 are activated (i.e., the insertion of the audio jack 20 into the audio jack socket 100 is detected), the controller 220*a* may make the transition to an audio jack insertion state S50*a*.

In the audio jack insertion state S50*a*, the impedance detector 210*a*' may be set to the second detection mode by the controller 220*a*' (CTRL=M2), so that the resistance R_PU of the variable resistance circuit 214'*a* may remain R1//R2. When the second detection signal DET2 is deactivated (i.e., when the separation of the audio jack 20 is detected), the controller 220*a*' may make the transition to the moisture detection state S30*a*. Otherwise, the controller 220*a*' may stay in the audio jack insertion state S50*a*.

The controller 220*a*' may generate an output signal OUT corresponding to each of the states S10*a*, S30*a*, and S50*a* shown in FIG. 5. For example, the controller 220*a*' may generate a first output signal in the open state S10*a*, generate a second output signal in the moisture detection state S30*a*, and a third output signal in the audio jack insertion state S50*a*. Since each of the open state S10*a* and the moisture detection state S30*a* is a state in which the audio jack 20 is not inserted in the audio jack socket 100, the first output signal may be equal to the second output signal in an embodiment.

Figure 6:
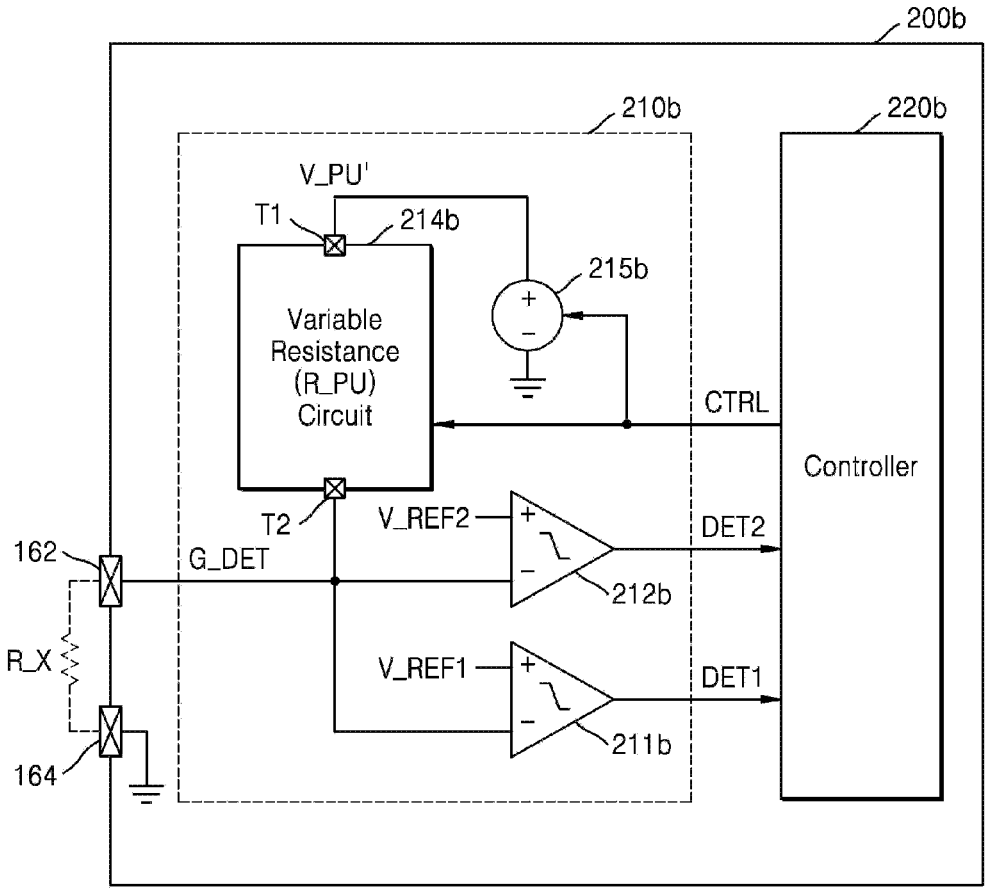
FIG. 6 is a block diagram of an audio jack detection circuit according to an exemplary embodiment.
Figure 7:
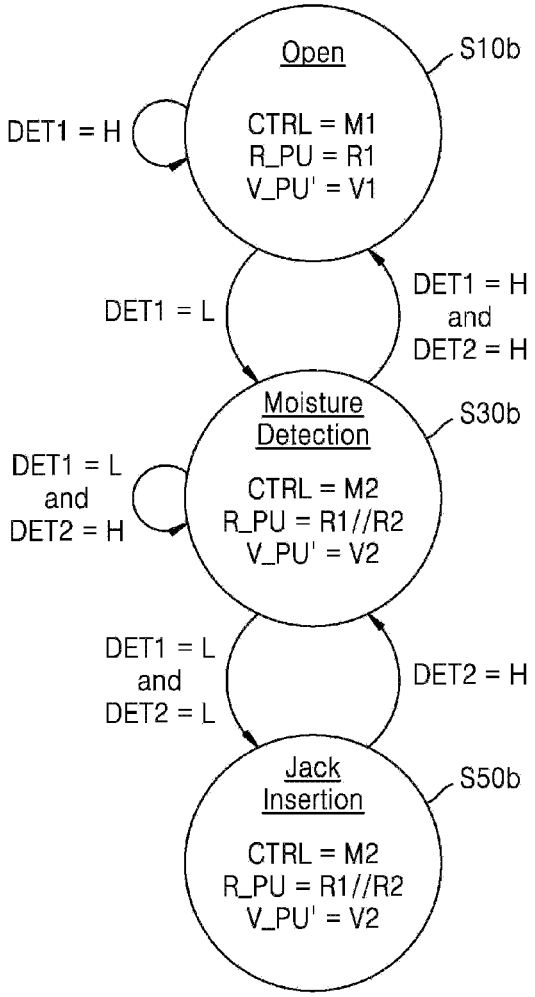
FIG. 7 is a state machine diagram corresponding to an operation of a controller of FIG. 6.

FIG. 6 is a block diagram of an audio jack detection circuit 200*b* according to an exemplary embodiment, and FIG. 7 is a state machine diagram corresponding to an operation of a controller 220*b* of FIG. 6. As compared with the audio jack detection circuit 200*a*' of FIG. 4, the audio jack detection circuit 200*b* of FIG. 6 may further include a variable voltage source 215*b*. In FIGS. 6 and 7, the same descriptions as with reference to FIGS. 4 and 5 will be omitted.

Referring to FIG. 6, the variable voltage source 215*b* may generate an output voltage V_PU', which may vary in response to a control signal CTRL for setting a detection mode of the impedance detector 210*b*, and the output voltage V_PU' generated by the variable voltage source 215*b* may be applied to a first terminal T1 of a variable resistance circuit 214*b*. That is, a pull-up voltage V_PU' of a ground detection pin 162 may vary depending on a detection mode.

In the second detection mode in which the variable resistance circuit 214*b* has a relatively low resistance, to reduce current flowing from the pull-up voltage V_PU' through the first and second terminals T1 and T2 of the variable resistance circuit 214*b*, the ground detection pin 162, and the ground pin 164 to a ground electric potential, the pull-up voltage V_PU' generated by the variable voltage source 215*b* may be lower in the second detection mode than in the first detection mode. For example, the variable voltage source 215*b* may provide a pull-up voltage V_PU' of about 1.8 V in the first detection mode and provide a pull-up voltage V_PU' of about 1 V in the second detection mode. Thus, power consumed by the impedance detector 210*b* may be reduced, and therefore, power consumption of an audio device (e.g., the audio device 10 of FIG. 1) including the audio jack detection circuit 200*b* may be reduced.

Referring to FIG. 7, in an open state S10*b* of the audio jack socket 100, the variable voltage source 215*b* may provide a first voltage V1 as a pull-up voltage V_PU' in response to a control signal CTRL (=M1) for setting a first detection mode. Also, in a moisture detection state S30*b*, the variable voltage source 215*b* may provide a second voltage V2 as a pull-up voltage V_PU' in response to a control signal CTRL (=M2) for setting a second detection mode. The second voltage V2 may be lower than the first voltage V1. In an audio jack insertion state S50*b*, the variable voltage source 215*b* may provide the second voltage V2 as the pull-up voltage V_PU' in response to the control signal CTRL (=M2) for setting the second detection mode.

Figure 8:
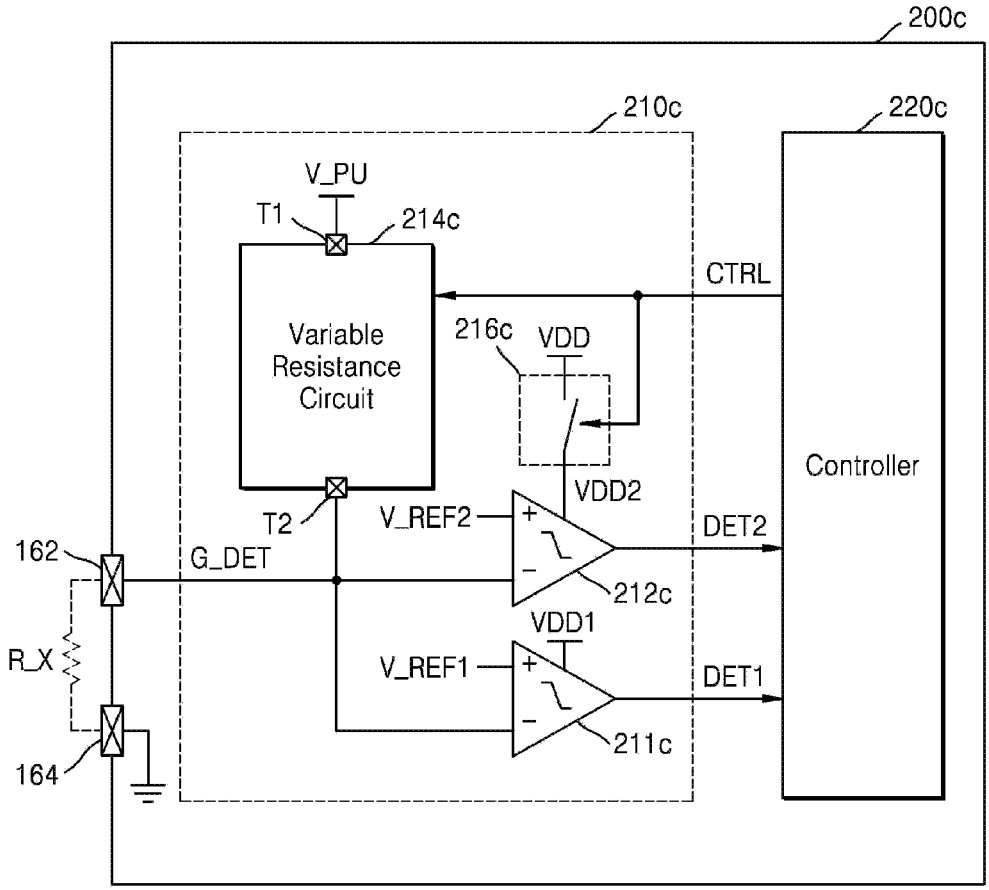
FIG. 8 is a block diagram of an audio jack detection circuit according to an exemplary embodiment.
Figure 9:
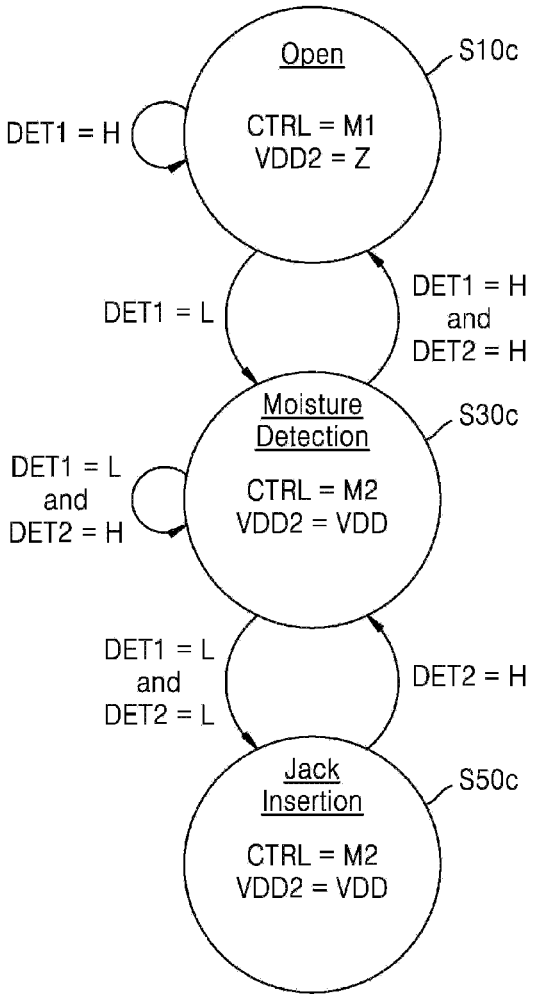
FIG. 9 is a state machine diagram corresponding to an operation of a controller of FIG. 8.

FIG. 8 is a block diagram of an audio jack detection circuit 200*c* according to an exemplary embodiment, and FIG. 9 is a state machine diagram corresponding to an operation of a controller 220*c* of FIG. 8. As compared with the audio jack detection circuit 200*a*' of FIG. 4, the audio jack detection circuit 200*c* of FIG. 8 may further include a power gating circuit 216*c*. In FIGS. 8 and 9, the same descriptions as with reference to FIGS. 4 and 5 will be omitted.

Referring to FIG. 8, the power gating circuit 216*c* may supply power to the second comparator 212*c* or block the supply of power to the second comparator 212*c* in response to a control signal CTRL for setting a detection mode of an impedance detector 210*c*. For example, it may be determined whether the second comparator 212*c* is to operate depending on a detection mode. Thus, power consumed by the impedance detector 210*c* may be reduced, and therefore, power consumption of an audio device (e.g., the audio device 10 of FIG. 1) including the audio jack detection circuit 200*c* may be reduced.

In a first detection mode in which the controller 220*c* does not determine whether a second detection signal DET2 is activated, to remove power consumed by the second comparator 212*c*, the application of a power supply voltage VDD to the second comparator 212*c* may be blocked by the power gating circuit 216*c*. In a second detection mode in which the controller 220*c* determines whether the second detection signal DET2 is activated, the power supply voltage VDD may be applied by the power gating circuit 216*c* to the second comparator 212*c*.

Referring to FIG. 9, in an open state S10*c* of an audio jack socket 100, the power gating circuit 216*c* may prevent application of the power supply voltage VDD to a power node VDD2 of the second comparator 212*c* in response to a control signal CTRL (=M1) for setting the first detection mode. In the first detection mode, the power node VDD2 of the second comparator 212*c* may be in a high-impedance state Z, or a ground electric potential may be applied to the power node VDD2 of the second comparator 212*c*. Also, in a moisture detection state S30*c*, the power gating circuit 216*c* may provide the power supply voltage VDD to the power node VDD2 of the second comparator 212*c* in response to a control signal CTRL (=M2) for setting the second detection mode. In an audio jack insertion state S50*c*, the power gating circuit 216*c* may provide the power supply voltage VDD to the power node VDD2 of the second comparator 212*c* in response to the control signal CTRL (=M2) for setting the second detection mode.

Figure 10:
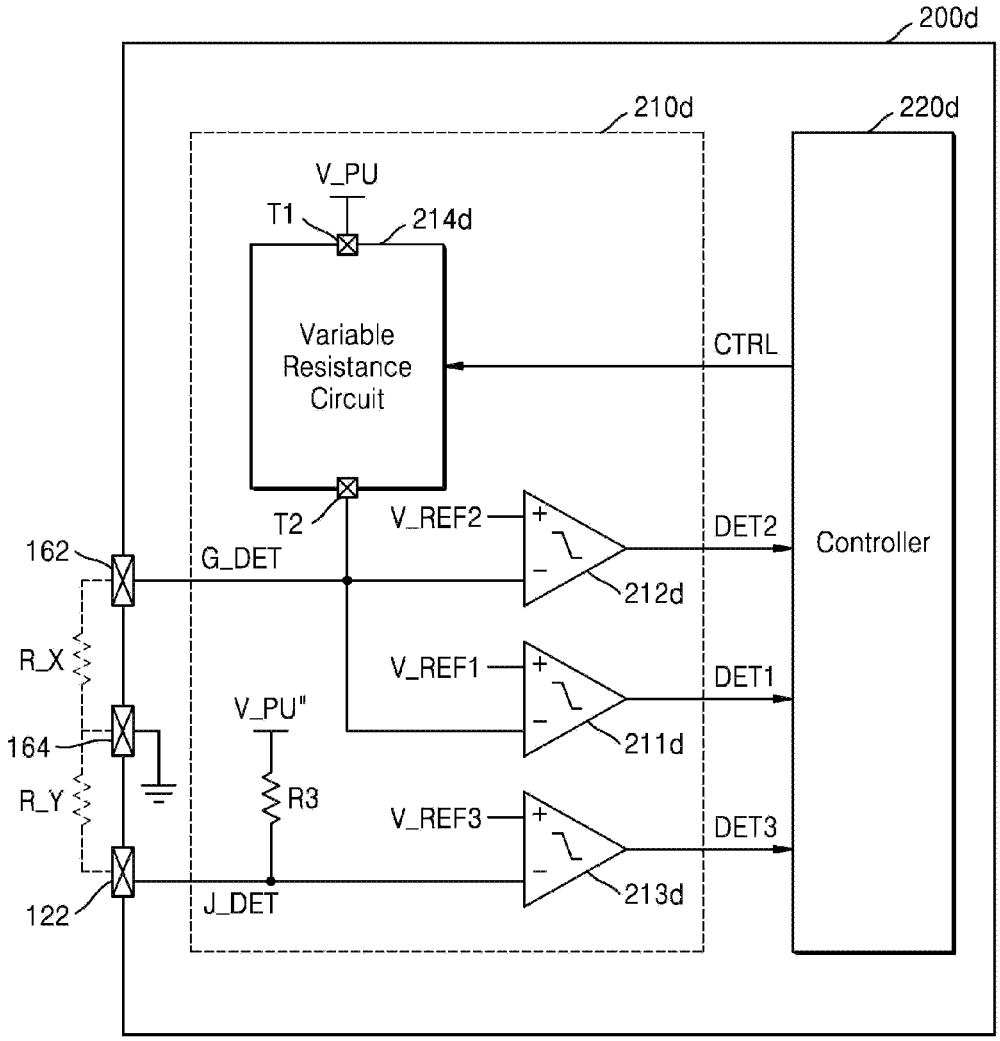
FIG. 10 is a block diagram of an audio jack detection circuit according to an exemplary embodiment.
Figure 11:
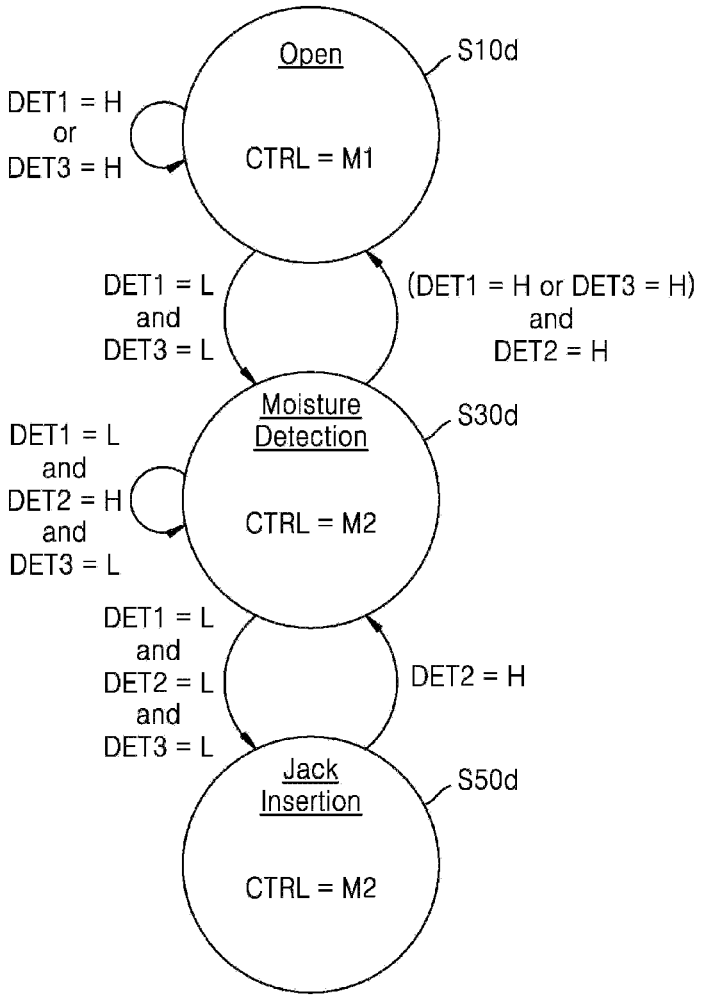
FIG. 11 is a state machine diagram corresponding to an operation of a controller of FIG. 10.

FIG. 10 is a block diagram of an audio jack detection circuit 200*d* according to an exemplary embodiment, and FIG. 11 is a state machine diagram corresponding to an operation of a controller 220*d* of FIG. 10. As compared with the audio jack detection circuit 200*a*' of FIG. 4, the audio jack detection circuit 200*d* of FIG. 10 may further include a third comparator 213*d*. In FIGS. 10 and 11, the same descriptions as with reference to FIGS. 4 and 5 will be omitted.

In an exemplary embodiment, the audio jack detection circuit 200*d* may detect an impedance between a jack detection pin 122 and a ground pin 164, and the controller 220*d* may determine a state of an audio jack socket 100 based on not only a first impedance between a ground detection pin 162 and the ground pin 164 but also a second impedance between the jack detection pin 122 and the ground pin 164. For example, as shown in FIG. 2B, the jack detection pin 122, which is in contact with the left signal terminal L located at an end terminal of the audio jack 20 when the audio jack 20 is inserted in the audio jack socket 100, may be located in the deepest portion of the audio jack socket 100. The jack detection pin 122 may be used to determine whether the audio jack 20 is completely inserted into the audio jack socket 100.

Referring to FIG. 10, to detect the second impedance between the jack detection pin 122 and the ground pin 164, an impedance detector 210*d* may include a pull-up resistor and a third comparator 213*d*. The pull-up resistor may be connected to the jack detection pin 122 and have a resistance R3. The third comparator 213*d* may compare a voltage J_DET of the jack detection pin 122 with a third reference voltage V_REF3 and generate a third detection signal DET3. Similar to the first and second comparators 211*d* and 212*d*, the third comparator 213*d* may generate a detection signal DET3 that is deactivated when the voltage J_DET of the jack detection pin 122 is higher than the third reference voltage V_REF3, and generate a detection signal DET3 that is activated when the voltage J_DET of the jack detection pin 122 is lower than the third reference voltage V_REF3. In an exemplary embodiment, the pull-up resistor connected to the jack detection pin 122 may have a resistance R3 of about 1 MΩ. A pull-up voltage V_PU of the ground detection pin 162 may have the same magnitude (e.g., about 1.8 V) as a pull-up voltage V_PU" of the jack detection pin 122 or be different from the pull-up voltage V_PU" of the jack detection pin 122.

Referring to FIG. 11, in an open state S10*d* of the audio jack socket 100, when the first detection signal DET1 or the third detection signal DET2 is deactivated (i.e., when the audio jack socket 100 is in an open state or when the audio jack 20 is not completely inserted into the audio jack socket 100), the controller 220*d* may stay in an open state S10*d*. Otherwise, when both the first and third detection signals DET1 and DET3 are activated (i.e., when the audio jack 20 is inserted in the audio jack socket 100 or the foreign material 30 has flowed into the audio jack socket 100), the controller 220*d* may be put into a moisture detection state S30*d*.

In the moisture detection state S30*d*, when the first detection signal DET1 or the third detection signal DET3 is deactivated and the second detection signal DET2 is deactivated (i.e., when the audio jack socket 100 is dried or the audio jack 20 is separated from the audio jack socket 100), the controller 220*d* may be put into the open state S10*d*. Otherwise, when both the first and third detection signals DET1 and DET3 are activated and the second detection signal DET2 is deactivated (i.e., when the foreign material 30 has flowed into the audio jack socket 100 and remains in the audio jack socket 100), the controller 220*d* may stay in a moisture detection state S30*d*. When all of the first to third detection signals DET1, DET2, and DET3 are activated (i.e., when the audio jack 20 is completely inserted into the audio jack socket 100), the controller 220*d* may be put into an audio jack insertion state S50*d*.

In the audio jack insertion state S50*d*, if the second detection signal DET2 is deactivated (i.e., if the audio jack 20 is separated from the audio jack socket 100), the controller 220*d* may make the transition to the moisture detection state S30*d*. Otherwise, the controller 220*d* may stay in the audio jack insertion state S50*d*.

The controller 220*d* may generate first to third output signals in the open state S10*d*, the moisture detection state S30*d*, and the audio jack insertion state S50*d*, respectively. In an exemplary embodiment, the first output signal may be equal to the second output signal.

Figure 12:
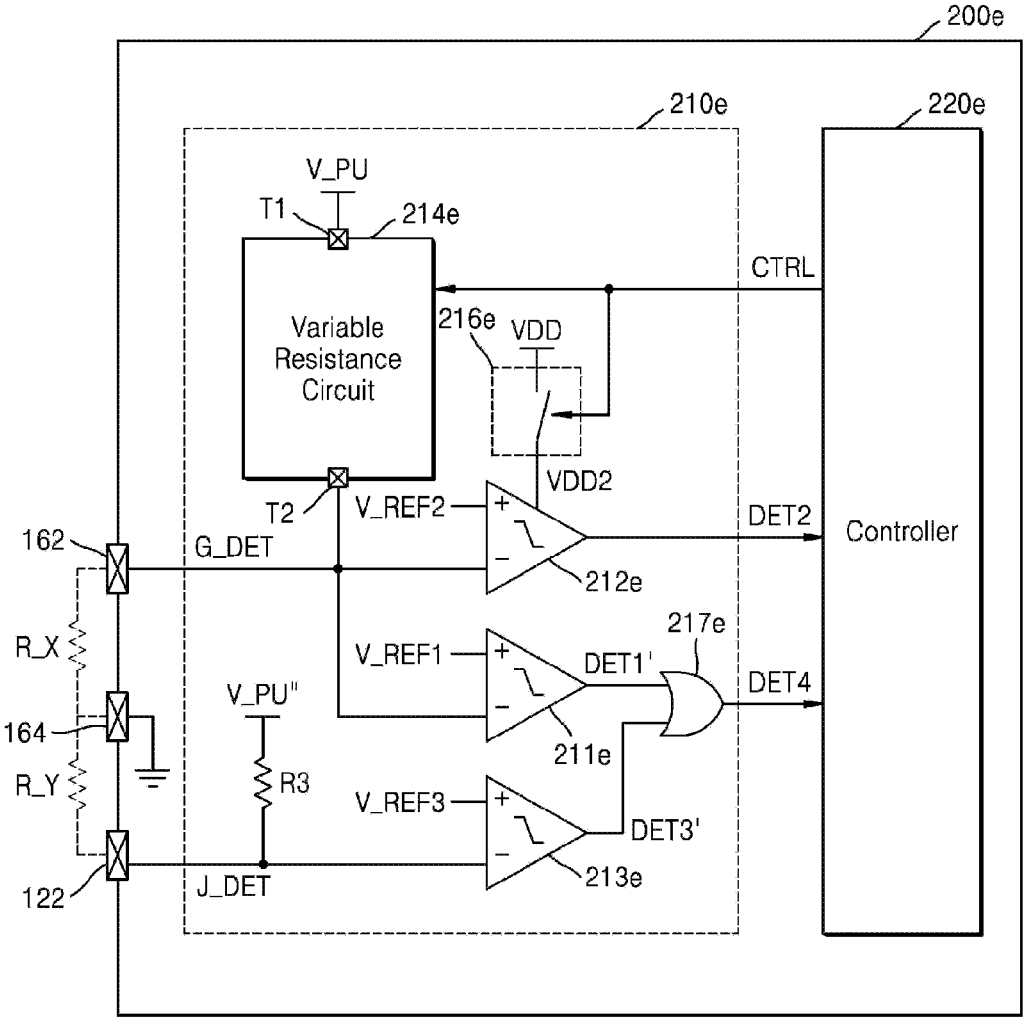
FIG. 12 is a block diagram of an audio jack detection circuit according to an exemplary embodiment.
Figure 13:
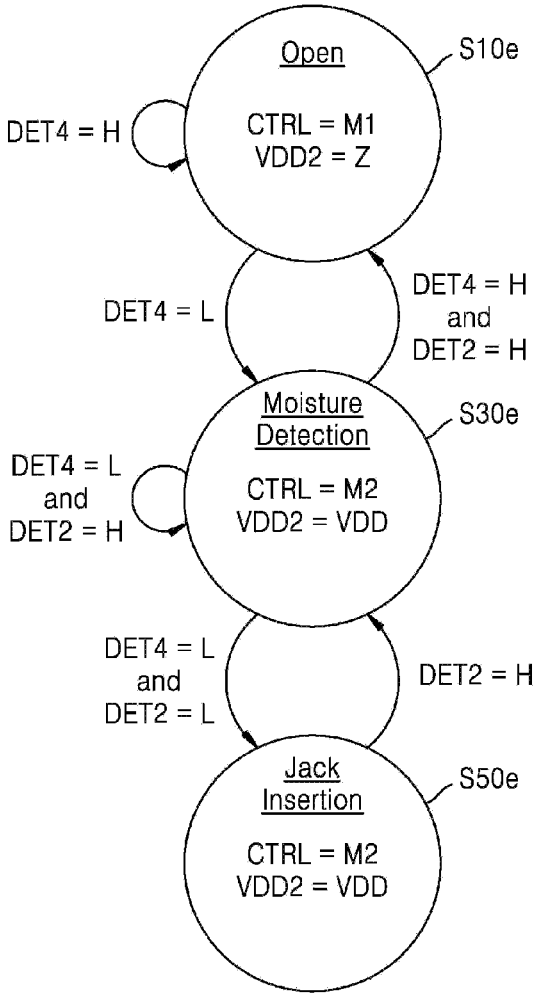
FIG. 13 is a state machine diagram corresponding to an operation of a controller of FIG. 12.

FIG. 12 is a block diagram of an audio jack detection circuit 200*e* according to an embodiment, and FIG. 13 is a state machine diagram corresponding to an operation of a controller 220*e* of FIG. 12. As compared with the audio jack detection circuit 200*d* of FIG. 10, the audio jack detection circuit 200*e* of FIG. 12 may further include a power gating circuit 216*e* and an OR gate 217*e*. In FIGS. 12 and 13, the same descriptions as with reference to FIGS. 10 and 11 will be omitted.

Referring to FIG. 12, the power gating circuit 216*e* may operate similarly to the power gating circuit 216*c* of FIG. 8. For example, the power gating circuit 216*c* may supply power to a second comparator 212*e* or block the supply of power to the second comparator 212*e* in response to a control signal CTRL. Referring to FIG. 13, the power gating circuit 216*e* may prevent application of a power supply voltage VDD to a power node VDD2 of the second comparator 212*e* in response to a control signal CTRL (=M1) for setting a first detection mode. Also, the power gating circuit 216*e* may provide the power supply voltage VDD to the power node VDD2 of the second comparator 212*e* in response to a control signal CTRL (=M2) for setting a second detection mode.

Referring to FIG. 12, first and third detection signals DET1' and DET3' generated by the first and third comparators 211*e* and 213*e* may be applied to the OR gate 217*e*, and an output signal of the OR gate 217*e* may be provided as a fourth detection signal DET4 to the controller 220*e*. For example, when one of the first and third detection signals DET1' and DET3' is deactivated, it may be determined that an audio jack socket 100 is in an open state. When both the first and third detection signals DET1' and DET3' are activated, it may be determined that the audio jack socket 100 is not in the open state (e.g., it may be determined that the audio jack socket 100 is either in a moisture state or in an audio jack insertion state). Thus, referring to FIG. 13, each of the first and third detection signals DET1 and DET3 of FIG. 11 may be replaced by the fourth detection signal DET4.

Figure 14A:
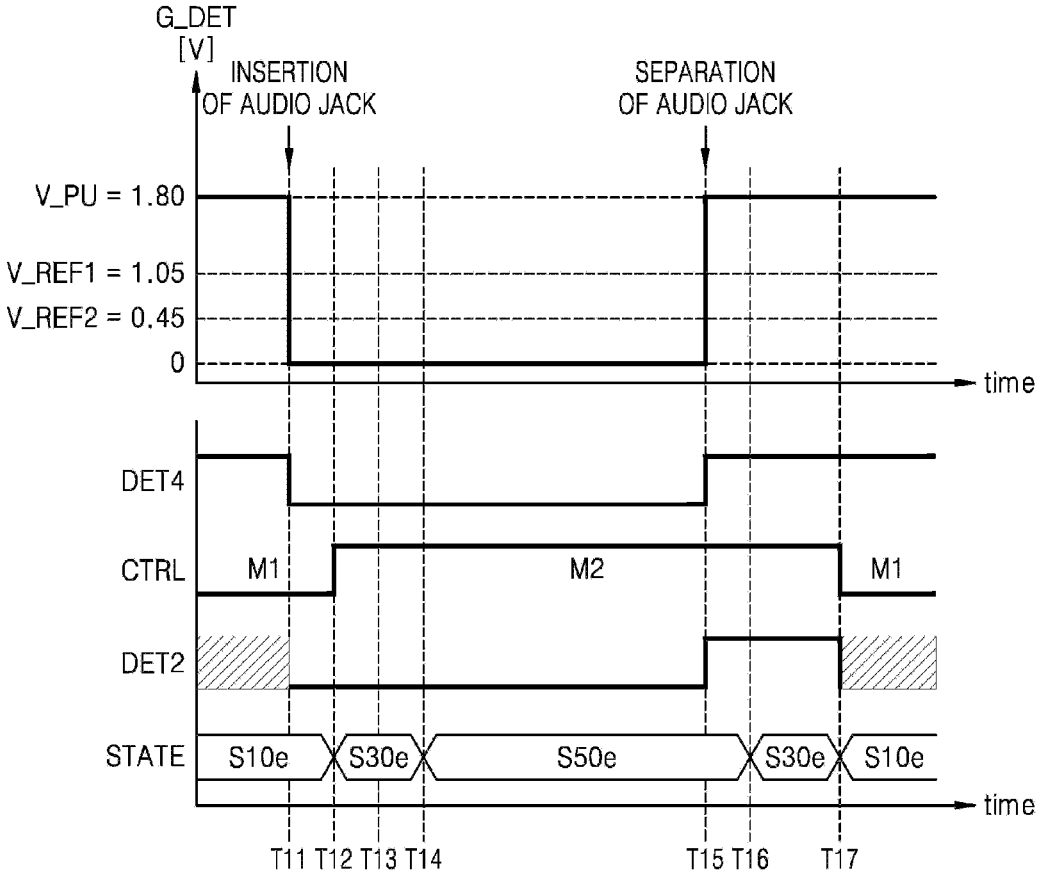
FIGS. 14A to 14C are graphs showing operations of the audio jack detection circuit of FIG. 12, under state variation scenarios of an audio jack socket, according to exemplary embodiments.
Figure 14B:
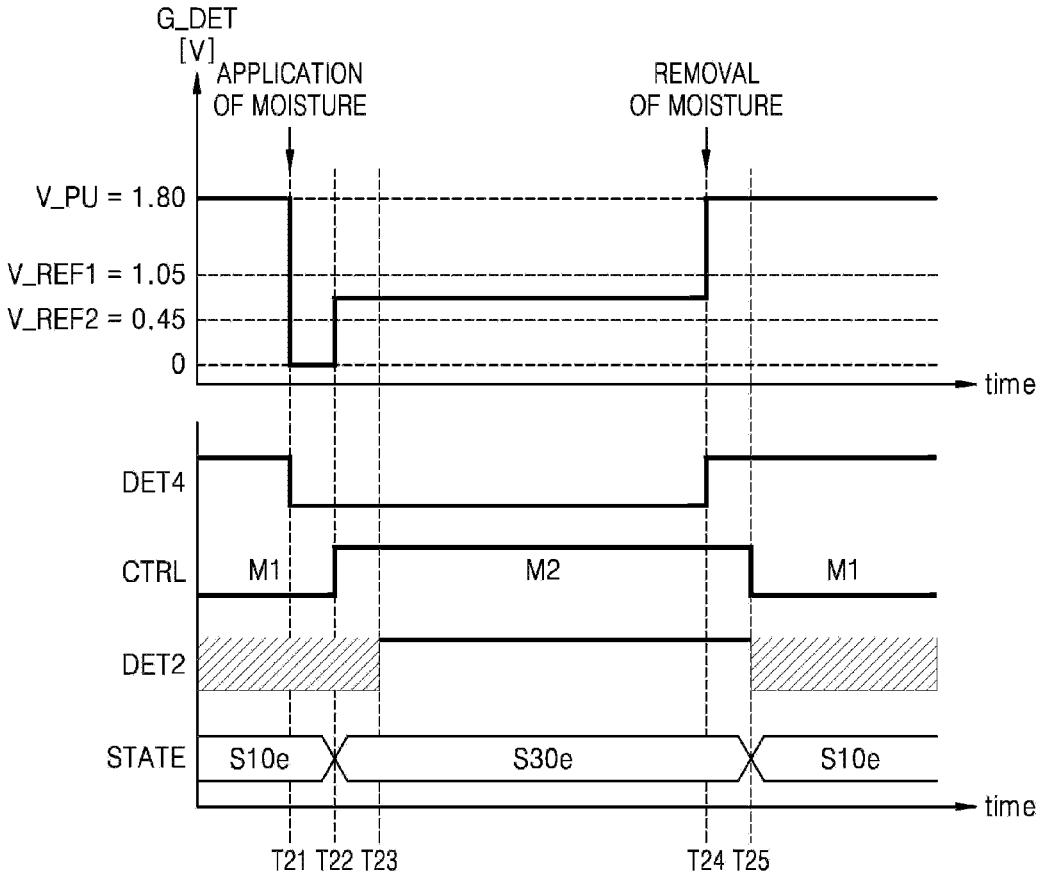
Figure 14C:
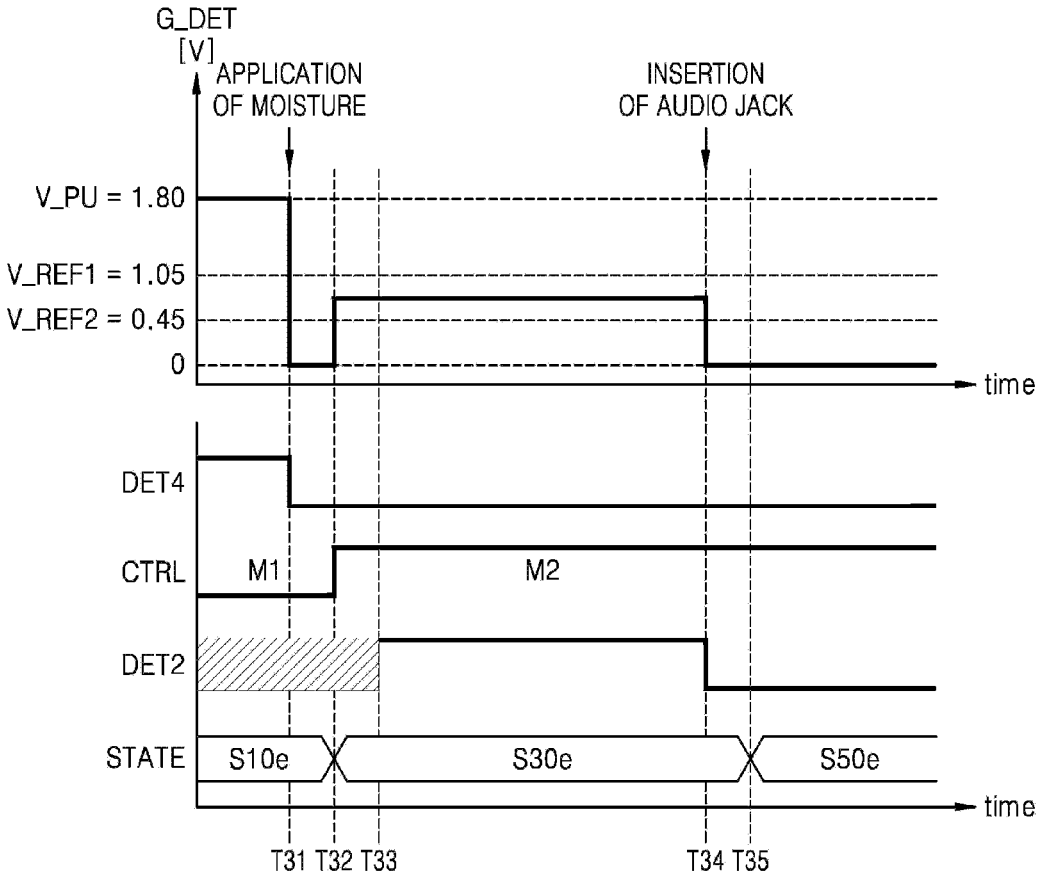

FIGS. 14A to 14C are graphs showing operations of the audio jack detection circuit 200*e* of FIG. 12, under state variation scenarios of the audio jack socket 100, according to exemplary embodiments. In FIGS. 14A to 14C, magnitudes of a voltage G_DET of the ground detection pin 122 may be examples, and states of FIGS. 14A to 14C may correspond to the states S10*e*, S30*e*, and S50*e* shown in the state machine diagram of FIG. 13. Also, in FIGS. 14A to 14C, a pull-up voltage V_PU of FIG. 12 may be about 1.8 V, a first reference voltage V_REF1 may be about 1.05 V, and a second reference voltage V_REF2 may be about 0.45 V. In FIGS. 14A to 14C, it is assumed that a variable resistance circuit 214*e* of FIG. 12 has a resistance of about 1 MΩ in a first detection mode and has a resistance of about 50 kΩ in a second detection mode. Hereinafter, FIGS. 14A to 14C will be described with reference to FIGS. 12 and 13.

FIG. 14A is a graph showing a variation in voltage G_DET of the ground detection pin 122 and variations of signals when the audio jack 20 is inserted in the audio jack socket 100 and then separated from the audio jack socket 200. Referring to FIG. 14A, at time T11, the audio jack 20 may be inserted into the audio jack socket 100. In this case, since a resistance R_X between the ground detection pin 162 and the ground pin 164 is substantially zero (0), the voltage G_DET of the ground detection pin 122 may be dropped from about 1.8 V, which is a pull-up voltage V_PU to about 0 V. Thus, a fourth detection signal DET4 may be activated (i.e., dropped to a low level). At time T12, the controller 220*e* may make the transition from an open state S10*e* to a moisture detection state S30*e* due to the transition of the fourth detection signal DET4. Thus, the control signal CTRL may set the second detection mode. At time T13, a resistance of the variable resistance circuit 214*e* may be reduced in response to a control signal CTRL (=M2) for setting the second detection mode. Although the resistance of the variable resistance circuit 214*e* is reduced, since a resistance R_X between the ground detection pin 162 and the ground pin 164 is substantially zero (0), the voltage G_DET may remain about 0 V. Since power is supplied to the second comparator 212*e* by the power gating circuit 216*e*, and the voltage G_DET of the ground detection pin 162 is lower than a second reference voltage V_REF2, the second comparator 212*e* may generate an activated second detection signal DET2. At time T14, the controller 220*e* may make the transition from a moisture detection state S30*e* to an audio jack insertion state 550*e* due to the activated second detection signal DET2.

Referring to FIG. 14A, at time T15, the audio jack 20 may be separated from the audio jack socket 100. In this case, since a resistance between the ground detection pin 162 and the ground pin 164 is substantially infinite, the voltage G_DET of the ground detection pin 162 may rise from about 0 V to about 1.8 V, which is the pull-up voltage V_PU. Thus, each of the second detection signal DET2 and the fourth detection signal DET4 may be deactivated (i.e., rise to a high level). At time T16, the controller 220*e* may make the transition from the audio jack insertion state S50*e* to the moisture detection state S30*e* due to the transition of the second detection signal DET2. At time T17, the controller 220*e* may make the transition from a moisture detection state S30*e* to an open state S10*e* due to the deactivated second and fourth detection signals DET2 and DET4. Thus, the control signal CTRL may set a first detection mode. As a result, a resistance of the variable resistance circuit 214*e* may be increased again, and power supplied to the second comparator 212*e* may be blocked.

FIG. 14B is a graph showing a variation in voltage G_DET of the ground detection pin 162 and variations in signals when the audio jack socket 100 is exposed to moisture and then moisture is removed from the audio jack socket 100. Referring to FIG. 14B, At time T21, for example, the foreign material 30 of FIG. 2C may flow into the audio jack socket 100 so that moisture may be applied to the audio jack socket 100. In this case, since a resistance R_X between the ground detection pin 162 and the ground pin 164 ranges from about 20 kΩ to about 300 kΩ according to properties of the foreign material 30, the voltage G_DET of the ground detection pin 162 may be dropped from about 1.8 V, which is the pull-up voltage V_PU. In the first detection mode, when the variable resistance circuit 214*e* of the ground detection pin 162 has a resistance of about 1 MΩ and the resistance R_X between the ground detection pin 162 and the ground pin 164, which is caused by the foreign material 30, is about 40 kΩ, the voltage G_DET may be reduced to substantially about 0 V, as shown in FIG. 14B. Thus, the fourth detection signal DET4 may be activated (i.e., dropped to a low level). At time T22, the controller 220*e* may make the transition from an open state S10*e* to a moisture detection state S30*e* due to the transition of the fourth detection signal DET4. Thus, the control signal CTRL may set a second detection mode. At time T23, a resistance of the variable resistance circuit 214*e* may be reduced in response to a control signal CTRL (=M2) for setting the second detection mode. In the second detection mode, when the variable resistance circuit 214*e* has a resistance of about 50 kΩ and a resistance R_X between the ground detection pin 162 and the ground pin 164 is about 40 kΩ, as shown in FIG. 14B, the voltage G_DET may become higher than about 0.45 V, which is a second reference voltage V_REF2. Since power is supplied to the second comparator 212*e* by the power gating circuit 216*e* and a voltage G_DET of the ground detection pin 162 is higher than the second reference voltage V_REF2, the second comparator 212*e* may generate a deactivated second detection signal DET2.

Referring to FIG. 14B, At time T24, for example, the audio jack socket 100 may be dried so that moisture may be removed from the audio jack socket 100. In this case, since a resistance R_X between the ground detection pin 162 and the ground pin 164 is substantially infinite, the voltage G_DET of the ground detection pin 162 may rise to about 1.8 V, which is the pull-up voltage V_PU. Thus, the fourth detection signal DET4 may be deactivated (i.e., rise to a high level). At time T25, the controller 220*e* may make the transition from a moisture detection state S30*e* to an open state S10*e* due to the deactivated second and fourth detection signals DET2 and DET4. Thus, the control signal CTRL may set a first detection mode. As a result, a resistance of the variable resistance circuit 214*e* may be increased again, and power supplied to the second comparator 212*e* may be blocked.

FIG. 14C is a graph showing a variation in voltage G_DET of the ground detection pin 162 and variations in signals when the audio jack socket 100 is exposed to moisture and then the audio jack 20 is inserted into the audio jack socket 100. Referring to FIG. 14C, At time T31, the audio jack socket 100 may be exposed to moisture. The variation in voltage G_DET and the variations in signals, which may occur at time points T21, T22, and T23 of FIG. 14B, may similarly occur at time points T31, T32, and T33 of FIG. 14C, respectively. Thus, since the time point T33, the voltage G_DET of the ground detection pin 162 may remain about 0.45 V, the controller 220*e* may stay in the moisture detection state S30*e*, and the control signal CTRL may set a second detection mode.

Referring to FIG. 14C, At time T34, the audio jack 20 may be inserted into the audio jack socket 100. In this case, since the resistance R_X between the ground detection pin 162 and the ground pin 164 is substantially zero (or 0), the voltage G_DET of the ground detection pin 162 may be reduced to about 0 V. Thus, the fourth detection signal DET4 may be activated (i.e., dropped to a low level), and the second detection signal DET2 may also be activated (i.e., dropped to a low level). At time T35, the controller 220*e* may make the transition from a moisture detection state S30*e* to an audio jack insertion state S50*e* due to the activated second and fourth detection signals DET2 and DET4.

Figure 15:
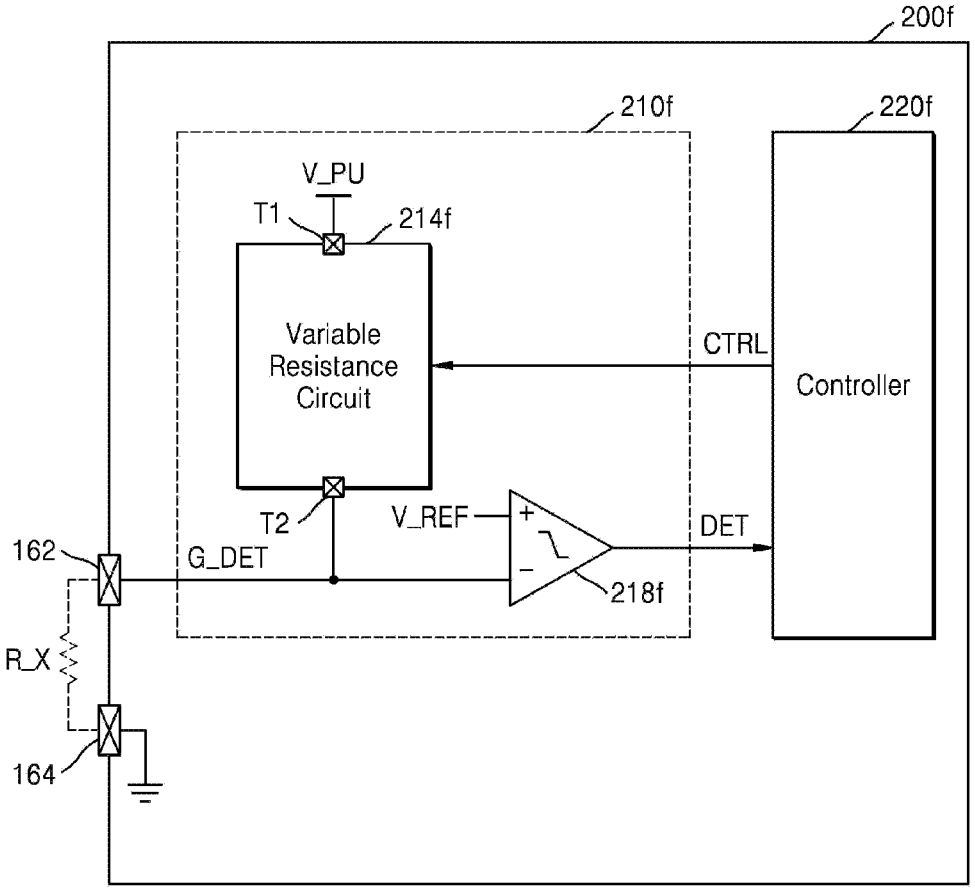
FIGS. 15 and 16 are block diagrams of an audio jack detection circuit according to exemplary embodiments.
Figure 16:
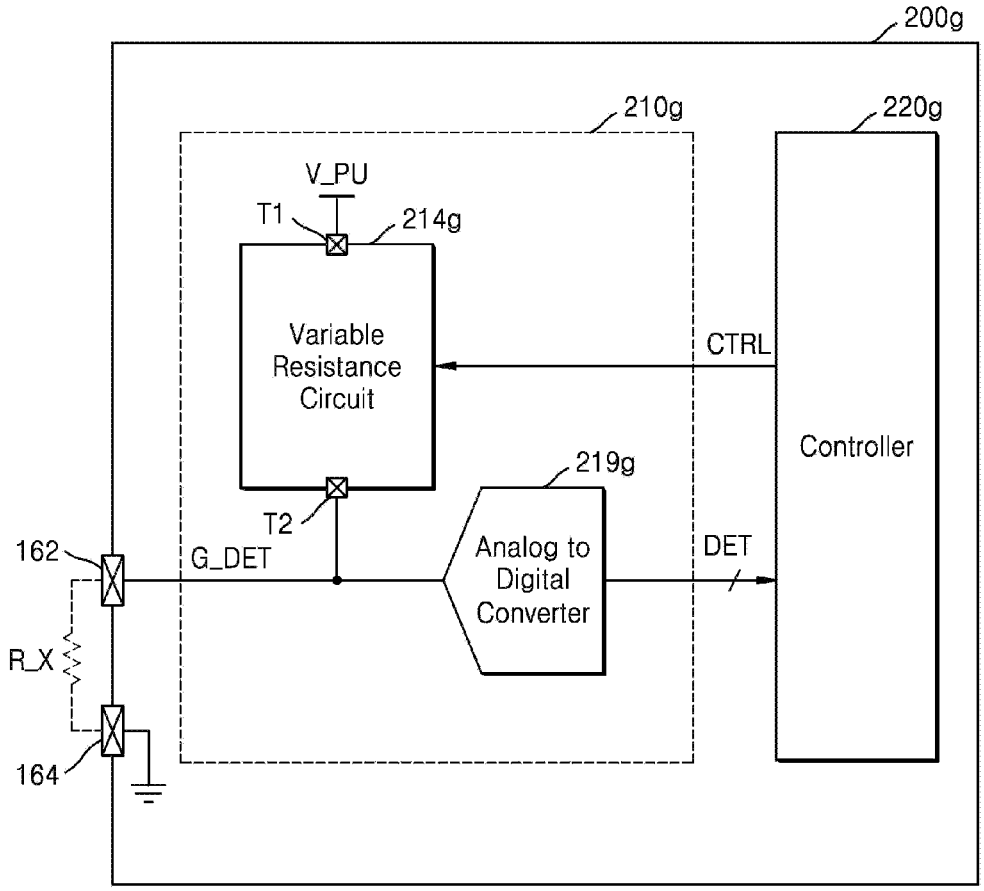

FIGS. 15 and 16 are block diagrams of audio jack detection circuits 200*f* and 200*g*, respectively, according to exemplary embodiments. As shown in FIGS. 15 and 16, the audio jack detection circuits 200*f* and 200*g* may include impedance detectors 210*f* and 210*g* and controllers 220*f* and 220*g*, respectively.

Referring to FIG. 15, the impedance detector 210*f* of the audio jack detection circuit 200*f* may include a comparator 218*f* to detect a resistance R_X between a ground detection pin 162 and a ground pin 164. The comparator 218*f* may compare a voltage G_DET of a ground detection pin 162 with a reference voltage V_REF and generate a detection signal DET. The reference voltage V_REF may have an appropriate magnitude in detecting each of a state of the insertion of the audio jack 20 as shown in FIG. 2B and a state of the inflow of the foreign material 30 as shown in FIG. 2C. For example, referring to FIG. 14C, the reference voltage V_REF may range from about 0.45 V to about 0 V. Thus, the comparator 218*f* may generate an activated detection signal DET at the insertion of the audio jack 20, and generate a deactivated detection signal DET at the inflow of the foreign material 30.

According to an exemplary embodiment, the reference voltage V_REF may vary according to a detection mode. For example, the reference voltage V_REF may be comparatively high in a first detection mode in which a variable resistance circuit 214*f* has a relatively high resistance, and be comparatively low in a second detection mode in which the variable resistance circuit 214*f* has a relatively low resistance. For example, referring to FIG. 14C, the reference voltage V_REF may be about 1.05 V (i.e., a first reference voltage V_REF1) in the first detection mode and be about 0.45 V (i.e., a second reference voltage V_REF2) in the second detection mode.

Referring to FIG. 16, the impedance detector 210*g* of the audio jack detection circuit 200*g* may include an analog-to-digital converter (ADC) 219*g* to detect a resistance R_X between the ground detection pin 162 and the ground pin 164. The ADC 219*g* may provide a digital signal corresponding to a magnitude of the voltage G_DET of the ground detection pin 162 as a detection signal DET to the controller 220*g*.

Figure 17:
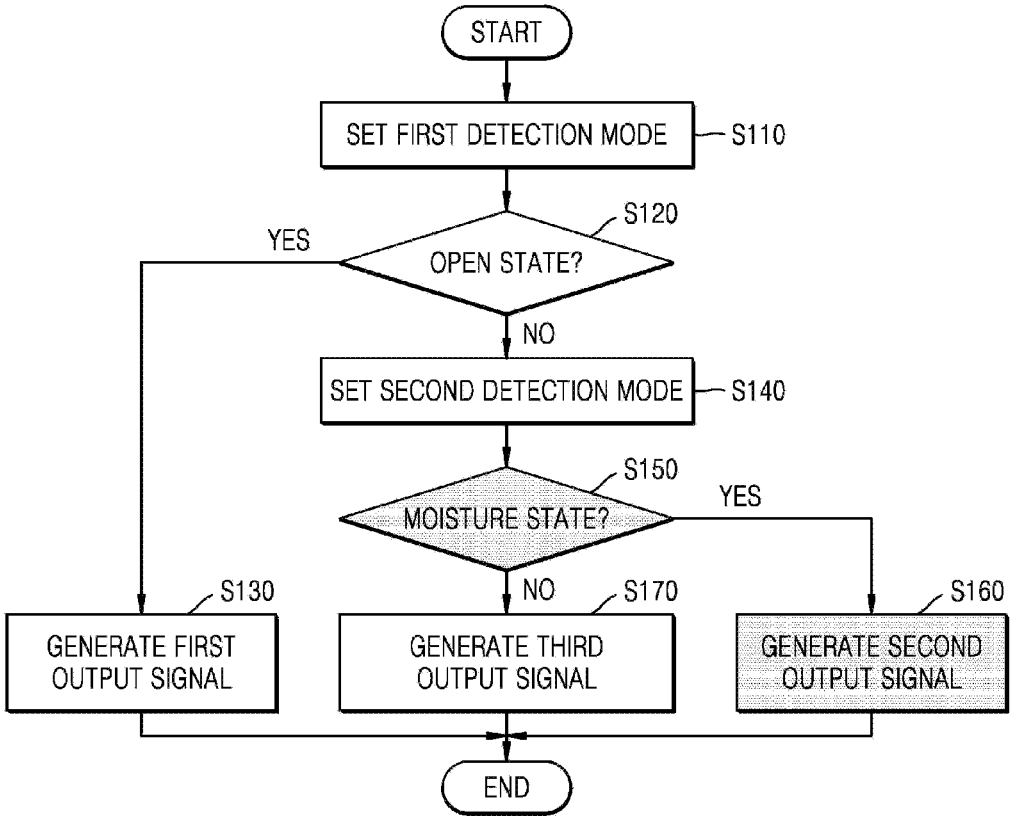
FIG. 17 is a flowchart of a method of detecting an audio jack according to an exemplary embodiment.

FIG. 17 is a flowchart of a method of detecting an audio jack according to an exemplary embodiment. Specifically, FIG. 17 is a flowchart of a process of generating an output signal OUT corresponding to a state of the audio jack socket 100 once by using the audio jack detection circuit 200 of FIG. 1. As described above, the audio jack detection circuit 200 may generate an output signal OUT corresponding to each of the states of the audio jack socket 100. Hereinafter, the flowchart of FIG. 17 will be described with reference to FIGS. 8 and 9. However, the present disclosure is not limited thereto.

Referring to FIG. 17, in operation S110, an operation of setting a first detection mode may be performed. For example, the controller 220*c* may generate a control signal CTRL for setting the first detection mode. Thus, the variable resistance circuit 214*c* of the impedance detector 210*c* may have a relatively high resistance, and power supplied to the second comparator 212*c* may be blocked.

In operation S120, an operation of determining whether the audio jack socket 100 is in an open state may be performed. For example, the controller 220*c* may determine whether the audio jack socket 100 is in the open state, based on a first detection signal DET1 of the first comparator 211*c*. If the audio jack socket 100 is in the open state (i.e., if the first detection signal DET1 is deactivated), an operation of generating a first output signal corresponding to the output state may be performed in operation S130.

If the audio jack socket 100 is not in the open state (i.e., if the first detection signal DET1 is activated), an operation of setting a second detection mode may be performed in operation S140. For example, the controller 220*c* may generate a control signal CTRL for setting the second detection mode. Thus, the variable resistance circuit 214*c* of the impedance detector 210*c* may have a relatively low resistance, and power may be supplied to the second comparator 212*c*.

In operation S150, an operation of determining whether the audio jack socket 100 is in a moisture state may be performed. For example, if the audio jack socket 100 is in the moisture state (i.e., if the first detection signal DET1 of the first comparator 211*c* is activated and the second detection signal DET2 of the second comparator 212*c* is deactivated), the controller 220*c* may perform an operation of generating a second output signal corresponding to the moisture state in operation S160.

If the audio jack socket 100 is not in the moisture state (i.e., if both the first and second detection signals DET1 and DET2 are activated), an operation of generating a third output signal corresponding to an audio jack insertion state may be performed in operation S170.

In some embodiments, a method of detecting the audio jack 20 configured to be inserted into the audio jack socket 100 of the audio device 10 may include: generating a first control signal for setting a first detection mode; determining, during the first detection mode, whether the audio jack socket 100 is in an open state based on a first detection signal; generating a first output signal corresponding to the open state of the audio jack socket 100 when it is determined that the audio jack socket 100 is in the open state; generating a second control signal for setting a second detection mode when it is determined that the audio jack socket 100 is not in the open state; determining, during the second detection mode, whether the audio jack socket 100 is in a moisture state in which conductive material other than the audio jack 20 is inserted into the audio jack socket 100; generating a second output signal corresponding to the moisture state of the audio jack socket 100 when it is determined that the audio jack socket 100 is in the moisture state; generating, during the second detection mode, a third output signal corresponding to an audio jack insertion state of the audio jack socket 100 when it is determined that the audio jack socket 100 is not in the moisture state. When the third output signal indicates a state of insertion of the audio jack 20 into the audio jack socket 100, the method may further include transmitting an audio signal to the audio jack socket 100. When the first output signal indicates the open state or when the second output signal indicates the moisture state, the method may further include blocking transmission of an audio signal to the audio jack socket. When the first output signal indicates the open state or when the second output signal indicates the moisture state, the method may further include blocking a supply of power to a circuit configured to generate or process an audio signal to the audio jack socket 100.

Figure 18:
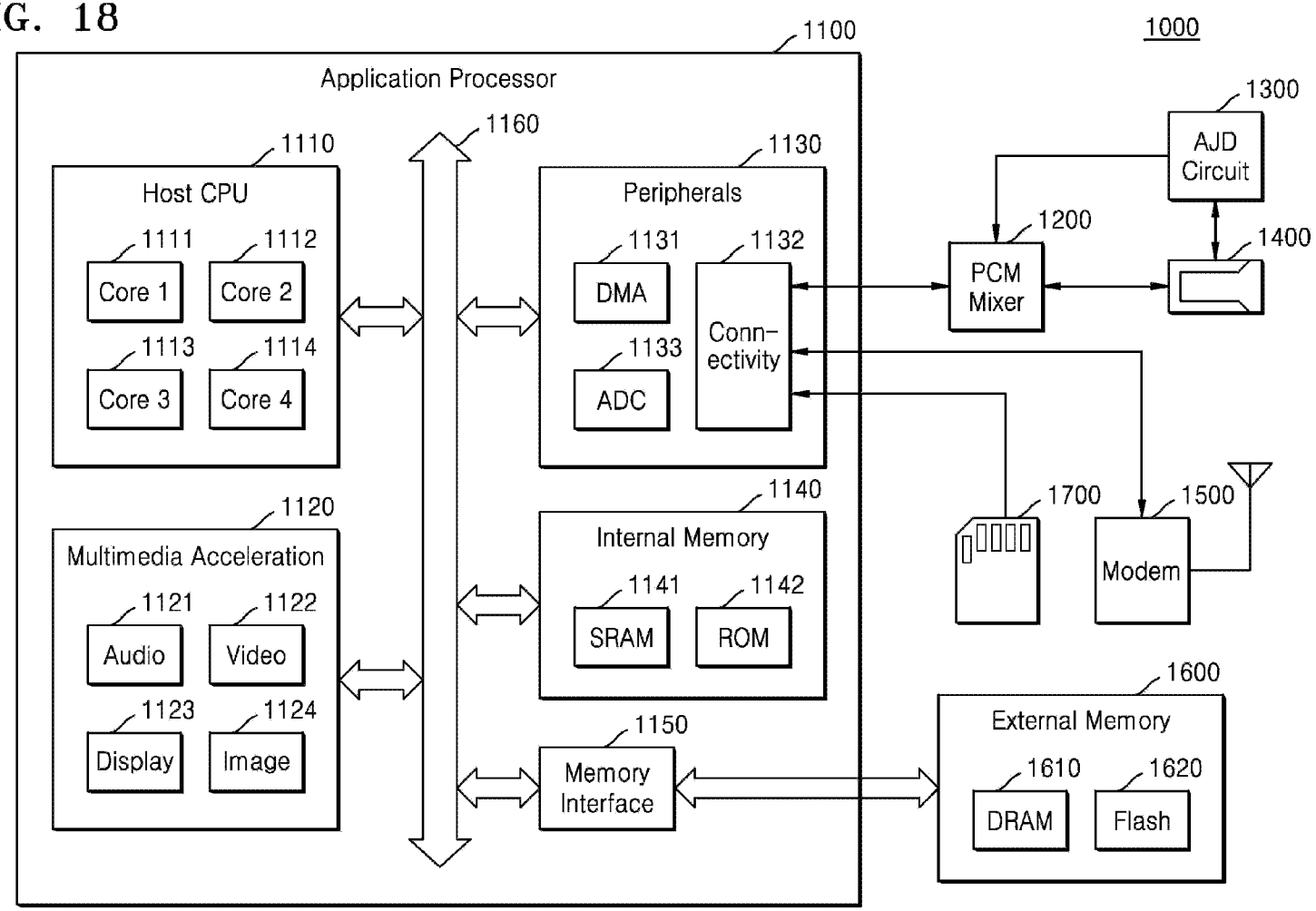
FIG. 18 is a block diagram of a computing system, which is an audio device according to an exemplary embodiment.

FIG. 18 is a block diagram of a computing system 1000, which is an audio device according to an exemplary embodiment. Similar to the audio device 10 of FIG. 1, the computing system 1000 may output an audio signal or receive the audio signal through an audio jack socket 1400. The computing system 1000 may be embodied by, but is not limited to, a personal computer (PC), a tablet PC, a mobile phone, a smartphone, an e-reader, a personal digital assistant (PDA), an enterprise digital assistant (EDA), a digital still camera, a digital video camera, a portable multimedia player (PMP), a personal navigation device or portable navigation device (PND), and/or a handheld game console.

Referring to FIG. 18, the computing system 1000 may include an application processor (AP) 1100, a pulse code modulation (PCM) mixer 1200, an audio jack detection circuit 1300, an audio jack socket 1400, a modem 1500, an external memory 1600, and a memory card 1700.

The AP 1100 may be a system-on-chip (SoC) for activating an operation and applications for the communication system 1000, and control other components of the computing system 1000. As shown in FIG. 18, the AP 1100 may include a host CPU 1110, a multimedia acceleration block 1120, peripherals 1130, an internal memory 1140, and a memory interface 1150. Components of the AP 1100 may be connected to a system bus 1160 to be capable of communicating with the system bus 1160. The system bus 1160 may be a multi-layered bus.

As shown in FIG. 18, the host CPU 1100 may include a plurality of cores 1111 to 1114, each of which may independently execute commands. Although not shown in FIG. 18, the host CPU 1110 may include a hierarchic cache memory. Unlike shown in FIG. 18, the host CPU 1110 may include less or more than four cores.

The multimedia acceleration block 1120 may include a plurality of logic blocks configured to process multimedia data. Each of the plurality of logic blocks included in the multimedia acceleration block 1120 may be configured to process multimedia data to increase efficiency of the AP 1100 and the computing system 1000. For instance, as shown in FIG. 18, the multimedia acceleration block 1120 may include an audio processing module 1121 (e.g., an audio processing circuit), a video processing module 1122 (e.g., a video processing circuit), a display driver module 1123 (e.g., a display driver circuit), and an image processing module 1124 (e.g., an image processing circuit). These various modules/circuits may include hardware, software, and/or firmware that perform various functions. The audio processing module 1121 may process source audio data and generate audio data for reproducing sound. Also, the audio processing module 1121 may process audio data generated from sound and generate target audio data. The video processing module 1122 may decode source video data that is compressed by a video codec. The display driver module 1123 may generate data corresponding to a signal provided to a display device (not shown) of the computing system 1000. The image processing module 1124 may decode source image data that is compressed by an image codec.

The peripherals 1130 may include a plurality of logic blocks configured to perform various functions, respectively. For example, as shown in FIG. 18, the peripherals 1130 may include a direct memory access (DMA) controller 1131 (e.g., a DMA controlling circuit), a connectivity module 1132 (e.g., a connectivity circuit), and an ADC 1133.

The DMA controller 1131 may control a DMA operation performed by the system bus 1160. For example, without regard to the host CPU 1110, the DMA controller 1131 may control the audio processing module 1121 to access data stored in the internal memory 1140 or access data stored in the external memory 1600 through the memory interface 1150.

The connectivity module 1132 may include a plurality of logic blocks configured to support a communication standard for enabling the AP 1100 to communicate with other components of the computing system 1000 or an external device of the computing system 1000. For example, as shown in FIG. 18, the connectivity module 1132 may include a logic block configured to support a serial bus interface standard, such as integrated interchip sound (I2S). The connectivity module 1132 may transmit audio data D_PCM generated by the audio processing module 1121 through I2S to the PCM mixer 1200 that is configured to receive the audio data and generate an audio signal.

According to exemplary embodiments, the audio jack detection circuit 1300 may detect an impedance between a ground detection pin and a ground pin of the audio jack socket 1400 in a plurality of detection modes corresponding to different detection ranges, and provide an output signal corresponding to a state of the audio jack socket 1400 to the PCM mixer 1200 based on the detected impedance. The PCM mixer 1200 may initiate or interrupt communication with the audio jack socket 1400 based on the output signal of the audio jack detection circuit 1300. Although FIG. 18 illustrates a case in which the output signal of the audio jack detection circuit 1300 is provided to the PCM mixer 1200, the present disclosure is not limited thereto. In other embodiments, the output signal of the audio jack detection circuit 1300 may be provided to the AP 1100, and the connectivity module 1132 included in the peripherals 1130 of the AP 1100 may initiate or interrupt the communication with the PCM mixer 1200 based on the output signal of the audio jack detection circuit 1300.

Referring to FIG. 18, the connectivity module 1132 may include a logic block configured to support communication with the modem 1500. The modem 1500 may provide an interface for enabling the computing system 1000 to communicate with another computing system located outside the computing system 1000. For example, the modem 1500 may provide an interface for wireless mobile communication and receive source audio data from another computing system through an antenna or transmit target audio data to another computing system through the antenna.

In addition, the connectivity module 1132 may include a logic block configured to support a card interface, for example, interfaces of a compact flash card (CFC), a microdrive, a smart media card (SMC), a multimedia card (MMC), a security digital card (SDC), and a memory stick. The connectivity module 1132 may read source audio data stored in the memory card 1700 from the memory card 1700 and transmit the read source audio data to the audio processing module 1121, the internal memory 1140, or the external memory 1600. The ADC 1133 may receive an analog signal and output digital data. For example, the ADC 1133 may be used to convert a user's input, which is received through a touch screen (not shown) included in the computing system 1000. The host CPU 1110 may interpret the user's input by referring to output data of the ADC 1133 of the peripherals 1130.

The internal memory 1140 may be a memory sub-system included in the AP 1100, and be connected to the system bus 1160 to be capable of communicating with the system bus 1160. As shown in FIG. 18, the internal memory 1140 may include SRAM 1141 and ROM 1142, and components of the AP 1100 may access the SRAM 1141 and the ROM 1142 through the system bus 1160.

The memory interface 1150 may provide an interface of the AP 1100 with the external memory 1600. For example, the external memory 1600 may include DRAM 1610 and flash 1620, and the memory interface 1150 may include a DRAM controller and a flash controller. Audio data, which is generated during an audio processing operation performed by the audio processing module 1121, may be stored in the DRAM 1610 of the external memory 1600 or the SRAM 1141 of the internal memory 1140.

While the present disclosure has been particularly shown and described with reference to embodiments thereof, it will be understood that various changes in form and details may be made therein without departing from the spirit and scope of the following claims.

What is claimed is:

1. An audio device comprising:

a first impedance detecting circuit having a different detection range depending on a detection mode, the first impedance detecting circuit configured to generate at least one ground detection signal corresponding to a first impedance between a ground pin and a ground detection pin, which are in contact with a ground terminal of an audio jack when the audio jack is inserted in an audio jack socket; and a controller configured to generate a control signal for setting the detection mode and generate one of first to third output signals corresponding respectively to an open state of the audio jack socket, a moisture state of the audio jack socket in which a conductive material other than the audio jack is inserted into the audio jack socket, and a state of insertion of the audio jack into the audio jack socket, based on the at least one ground detection signal.

2. The audio device of claim 1, wherein the first impedance detecting circuit comprises a variable resistance circuit having a first terminal to which a pull-up voltage is applied and a second terminal connected to the ground detection pin, wherein the variable resistance circuit has a variable resistance between the first and second terminals in response to the control signal, wherein the variable resistance circuit has a first resistance in a first detection mode, and has a second resistance in the second detection mode, the second resistance being lower than the first resistance.

3. The audio device of claim 2, wherein the controller determines whether the audio jack socket is in the open state in the first detection mode, and determines whether the audio jack socket is in a state of insertion of the audio jack into the audio jack socket or in the moisture state.

4. The audio device of claim 2, wherein the first impedance detecting circuit further comprises:

a first comparator configured to generate a first ground detection signal that is activated when a voltage from the ground detection pin is lower than a first reference voltage; and a second comparator configured to generate a second ground detection signal that is activated when a voltage from the ground detection pin is lower than a second reference voltage, the second reference voltage being lower than the first reference voltage, wherein, when the first ground detection signal is activated in the first detection mode, the controller generates the control signal for setting the second mode.

5. The audio device of claim 4, wherein the controller generates the first output signal when the first ground detection signal is deactivated in the first detection mode, generates the second output signal when the second ground detection signal is deactivated in the second detection mode, and generates the third output signal when the second ground detection signal is activated in the second detection mode.

6. The audio device of claim 4, further comprising a power gating circuit configured to supply power to the second comparator or block supply of power to the second comparator in response to the control signal, wherein the power gating circuit blocks the supply of power to the second comparator in the first mode, and supplies power to the second comparator in the second mode.

7. The audio device of claim 4, wherein the audio jack detection circuit further comprises a second impedance detecting circuit configured to generate a jack detection signal corresponding to a second impedance between the ground pin and a jack detection pin, which is in contact with a signal terminal of the audio jack along with a signal pin when the audio jack is inserted in the audio jack socket, wherein the controller generates one of the first to third output signals based on the jack detection signal.

8. The audio device of claim 7, wherein the second impedance detecting circuit comprises a third comparator configured to generate the jack detection signal that is activated when a voltage from the jack detection pin is lower than a third reference voltage, wherein the controller generates the first output signal when the jack detection signal or the first ground detection signal is deactivated in the first mode, generates the second output signal when the jack detection signal and the first ground detection signal are activated and the second ground detection signal is activated in the second mode, and generates the third output signal when the jack detection signal and the first and second ground detection signals are activated in the second mode.

9. The audio device of claim 2, wherein the first impedance detecting circuit further comprises a variable voltage source configured to generate the pull-up voltage, wherein, in response to the control signal, the variable voltage source generates a first pull-up voltage in the first mode, and generates a second pull-up voltage in the second mode, the second pull-up voltage being lower than the first pull-up voltage.

10. The audio device of claim 1, wherein the audio jack socket is included in the audio device and wherein the audio jack socket includes the ground pin and the ground detection pin, which are exposed on an inner wall of the audio jack socket.

11. The audio device of claim 1, wherein the first output signal is equal to the second output signal.

12. An audio device comprising:

an audio jack socket including a first signal pin, a jack detection pin, a second signal pin, a ground pin, a ground detection pin, and a microphone pin, which are exposed on an inner wall of the audio jack socket;

an audio jack detection circuit configured to detect a first impedance between the ground pin and the ground detection pin in each of at least two detection modes having different detection ranges, the audio jack detection circuit configured to generate an output signal indicating whether the audio jack socket is in a moisture state in which a conductive material other than the audio jack is inserted into the audio jack socket, based on the detected first impedance; and an audio signal processing module configured to initiate or interrupt communication with the audio jack socket in response to the output signal.

13. The device of claim 12, wherein the first signal pin and the jack detection pin are located to contact a first signal terminal of the audio jack, the second signal pin is located to contact a second signal terminal of the audio jack, the ground pin and the ground detection pin are located to contact a ground terminal of the audio jack, and the microphone pin is located to contact a microphone terminal of the audio jack.

14. The device of claim 12, wherein the audio jack detection circuit comprises a variable resistance circuit having a first terminal to which a pull-up voltage is applied and a second terminal connected to the ground detection pin, wherein the variable resistance circuit has a variable resistance between the first and second terminals depending on a detection mode.

15. The device of claim 14, wherein the audio jack detection circuit comprises a variable voltage source configured to generate the pull-up voltage, which varies depending on the detection mode.

16. The device of claim 12, wherein the audio jack detection circuit detects a second impedance between the jack detection pin and the ground pin, and generates an output signal corresponding to one of an open state of the audio jack socket, a state of insertion of the audio jack into the audio jack socket, and the moisture state of the audio jack socket, based on the second impedance.

17. An audio device comprising:

an audio jack socket including a ground pin and a ground detection pin which are exposed on an inner wall of the audio jack socket;

a first circuit having a first terminal connected to a variable voltage source configured to provide a pull-up voltage to the first terminal and a second terminal connected to the ground detection pin of the audio socket, wherein the first circuit has a first resistance in a first detection mode, and has a second resistance in a second detection mode, the second resistance being lower than the first resistance; and a second circuit configured to generate a corresponding control signal for setting the first detection mode and the second detection mode and generate one of first to third output signals corresponding respectively to a first state of the audio jack socket in which nothing is inserted into the audio jack socket, a second state of the audio jack socket in which a conductive material other than the audio jack is inserted into the audio jack socket, and a third state in which the audio jack is inserted into the audio jack socket, based on the at least one ground detection signal corresponding to an impedance between the ground pin and the ground detection pin.

18. The audio device of claim 17, wherein the first circuit comprises a switch through which the first and second terminals are connected, wherein the switch is configured to be turned on in response to a first control signal for setting the first detection mode, and be turned off in response to a second control signal for setting the second detection mode.

19. The audio device of claim 17, further comprising:

a first comparator configured to generate a first ground detection signal that is activated when a voltage from the ground detection pin is lower than a first reference voltage; and a second comparator configured to generate a second ground detection signal that is activated when a voltage from the ground detection pin is lower than a second reference voltage, the second reference voltage being lower than the first reference voltage, wherein, when the first ground detection signal is activated in the first detection mode, the second circuit generates the control signal for setting the second mode.

20. The audio device of claim 17, wherein:

in the first state of the audio jack socket, the variable voltage source provides a first voltage as the pull-up voltage in response to a first control signal for setting the first detection mode; and in the second state of the audio jack socket, the variable voltage source provides a second voltage as the pull-up voltage in response to a second control signal for setting the second detection mode, wherein the second voltage is lower than the first voltage.

* * * * *